US010113453B2

(12) United States Patent
McReynolds

(10) Patent No.: US 10,113,453 B2
(45) Date of Patent: Oct. 30, 2018

(54) MULTI-FUEL COMPRESSION IGNITION ENGINE

(71) Applicant: Randy Wayne McReynolds, Eaton, CO (US)

(72) Inventor: Randy Wayne McReynolds, Eaton, CO (US)

( * ) Notice: Subject to any disclaimer, the term of this patent is extended or adjusted under 35 U.S.C. 154(b) by 319 days.

(21) Appl. No.: 14/696,268

(22) Filed: Apr. 24, 2015

(65) Prior Publication Data

US 2016/0312752 A1 Oct. 27, 2016

(51) Int. Cl.

| | |
|---|---|
| ***F01L 9/02*** | (2006.01) |
| ***F02B 1/14*** | (2006.01) |
| ***F02M 59/10*** | (2006.01) |
| ***F01L 1/26*** | (2006.01) |

(52) U.S. Cl.

CPC ..... *F01L 9/023* (2013.01); *F01L 1/26* (2013.01); *F01L 9/02* (2013.01); *F01L 9/021* (2013.01); *F02B 1/14* (2013.01); *F02M 59/102* (2013.01)

(58) Field of Classification Search

CPC ..... F01L 9/023; F02M 59/102; F02B 1/14
See application file for complete search history.

(56) References Cited

U.S. PATENT DOCUMENTS 4,488,452 A * 12/1984 Jensen ..... F02B 67/04 123/41 R
4,606,708 A * 8/1986 Clark ..... F02B 75/04 417/380
4,637,209 A * 1/1987 Clark ..... F02B 75/04 417/11
4,898,078 A * 2/1990 Gage ..... E02F 9/2217 303/9.61
4,992,031 A * 2/1991 Sampo ..... F02B 71/045 417/287
5,339,777 A * 8/1994 Cannon ..... F01L 9/02 123/90.11
5,531,192 A * 7/1996 Feucht ..... F01L 9/02 123/90.12
5,572,961 A * 11/1996 Schechter ..... F01L 9/02 123/90.12
5,616,005 A * 4/1997 Whitehead ..... F01L 25/066 417/342
6,067,946 A * 5/2000 Bunker ..... F01L 9/02 123/90.12
6,092,495 A * 7/2000 Hackett ..... F01L 9/02 123/198 D
6,263,842 B1 * 7/2001 De Ojeda ..... F01L 9/02 123/90.11

(Continued)

OTHER PUBLICATIONS

Stinson. Diesel Engineering Handbook D794-D795. 11th Edition, 1970.

(Continued)

*Primary Examiner* — Joseph Dallo
(74) *Attorney, Agent, or Firm* — S&L US IP Attorneys, P.C.; Timothy Marc Shropshire; Eric Brandon Lovell

(57) ABSTRACT

An engine having subsystems and an operating cycle configured to meet all or a greater portion of the power requirements of the engine during the combustion period and not during the period in which the engine is not producing power, with the exception of the compression period and operation of an alternator.

18 Claims, 13 Drawing Sheets

COMBUSTION PERIOD 173

(56) References Cited

U.S. PATENT DOCUMENTS 6,308,690 B1 * 10/2001 Sturman ..... F01L 9/02 123/447
6,315,265 B1 * 11/2001 Adler ..... F01L 9/02 123/90.12
6,520,130 B2 * 2/2003 Chiappini ..... F01L 9/021 123/90.12
6,701,879 B2 * 3/2004 Diehl ..... F01L 1/12 123/90.12
7,021,277 B2 * 4/2006 Kuo ..... F02D 13/0215 123/295
7,051,700 B2 * 5/2006 Kuzuyama ..... F02D 13/0207 123/299
7,124,734 B2 * 10/2006 Almkvist ..... F02D 41/0002 123/299
7,150,250 B2 * 12/2006 Kuo ..... F02D 13/0215 123/299
7,152,559 B2 * 12/2006 Kuo ..... F02D 13/0207 123/299
7,152,573 B2 * 12/2006 Abet ..... F02D 41/027 123/299
7,204,212 B2 4/2007 Donaldson
7,204,227 B2 * 4/2007 Leone ..... F01N 3/0814 123/299
7,210,449 B2 * 5/2007 Beer ..... F02D 35/027 123/299
7,246,595 B1 * 7/2007 Hoare ..... F02D 13/0265 123/294
7,275,514 B2 * 10/2007 Kuo ..... F01L 13/00 123/299
7,275,515 B2 * 10/2007 Ikoma ..... F02D 41/3029 123/299
7,328,683 B2 * 2/2008 Weiss ..... F02D 37/02 123/295
7,398,644 B2 * 7/2008 Leone ..... F01N 3/0842 123/295
7,742,868 B2 * 6/2010 Kang ..... F02D 13/0265 123/299
7,783,410 B2 * 8/2010 Anderson ..... F02B 33/00 123/299
7,841,316 B2 * 11/2010 Inoue ..... F02D 13/0249 123/299
7,881,856 B2 * 2/2011 Shimizu ..... F01L 13/0021 123/299
8,028,679 B2 * 10/2011 Willi ..... F01L 1/34 123/348
8,191,531 B2 * 6/2012 Kang ..... F01L 9/02 123/345
8,272,207 B2 * 9/2012 Kurtz ..... F02D 41/024 123/27 R
8,430,072 B2 * 4/2013 Burkhard ..... F01L 1/14 123/90.12
8,433,501 B2 * 4/2013 Honda ..... F02D 35/025 123/299
8,485,148 B2 * 7/2013 Schiemann ..... F01L 9/02 123/90.12
8,590,506 B2 * 11/2013 Lee ..... F02B 17/005 123/299
9,157,402 B2 * 10/2015 Liu ..... F02M 59/025
9,284,865 B2 * 3/2016 Keller ..... F01L 1/14
9,441,573 B1 * 9/2016 Sergin ..... F02F 1/22
2002/0161541 A1 * 10/2002 Hou ..... G01L 25/00 702/105
2004/0025849 A1 * 2/2004 West ..... F02D 41/3836 123/480
2004/0211378 A1 * 10/2004 Diehl ..... F01L 9/02 123/90.13
2005/0005881 A1 * 1/2005 Diehl ..... F01L 9/02 123/90.12
2005/0183692 A1 * 8/2005 Weber ..... F01L 13/0015 123/299
2005/0235950 A1 * 10/2005 Weber ..... F01L 1/34 123/299
2005/0241611 A1 * 11/2005 Weber ..... F01L 1/181 123/299
2005/0247284 A1 * 11/2005 Weber ..... F01L 13/0015 123/299
2006/0005806 A1 * 1/2006 Kuo ..... F01L 13/0015 123/299
2006/0130805 A1 * 6/2006 Juretzka ..... F02D 41/403 123/299
2007/0131203 A1 * 6/2007 Ohga ..... F02D 41/402 123/478
2008/0006231 A1 * 1/2008 Noss ..... F01L 1/267 123/90.12
2008/0060609 A1 * 3/2008 Surnilla ..... F01L 9/04 123/299
2008/0178836 A1 * 7/2008 Yamashita ..... F02B 17/00 123/295
2008/0201056 A1 * 8/2008 Moriya ..... F02D 35/023 701/103
2008/0210195 A1 * 9/2008 Saruwatari ..... F02D 13/0226 123/299
2008/0264037 A1 * 10/2008 Takahashi ..... F01N 11/002 60/277
2009/0120068 A1 * 5/2009 Sakimoto ..... F01N 3/0231 60/285
2009/0192693 A1 * 7/2009 Bottcher ..... F02D 41/0072 701/102
2009/0192699 A1 * 7/2009 Bottcher ..... F02D 41/0072 701/108
2009/0281708 A1 * 11/2009 Loeffler ..... F02D 35/02 701/103
2010/0077989 A1 * 4/2010 Yamakawa ..... F02D 13/0219 123/299
2010/0108025 A1 * 5/2010 Yuzaki ..... F02D 41/068 123/299
2010/0236517 A1 * 9/2010 Hatamura ..... F01L 13/0026 123/299
2010/0294220 A1 * 11/2010 Ferreri ..... F01L 9/023 123/90.11
2010/0313845 A1 * 12/2010 Santoso ..... F02B 17/005 123/295
2011/0023454 A1 * 2/2011 Kurtz ..... F02D 41/024 60/274
2011/0232263 A1 * 9/2011 Yasui ..... F01N 3/0842 60/274
2014/0020644 A1 * 1/2014 Roberts ..... F01L 1/18 123/90.46
2014/0299194 A1 * 10/2014 Liu ..... F02M 59/025 137/1
2015/0275723 A1 * 10/2015 Koch ..... F02D 13/0249 60/605.2
2016/0084122 A1 * 3/2016 Baltrucki ..... F01L 9/023 123/90.12

OTHER PUBLICATIONS

Aerocharger. Variable-Vane, Self-Contained, No-Lag, Polaris Pro-RMK. Website, http://aerocharger.com, originally downloaded Dec. 18, 2014, 2 total pages.

Dtftool. Hydraulically Actuated Electronic Unit Injector (HEUI) Systems. PDF Ebook, www.manualways.com, Dec. 2001, pp. 326-367.

Holset. The Holset VG Turbocharger. Product Brochure, www.sdt-me.cz, 5 total pages.

Jinnai et al. A Variable Geometry (VG) Turbocharger for Passenger Cars to Meet European Union Regulations. Mitsubishi Heavy Industries Technical Review, Jun. 2012, vol. 49, No. 2, pp. 17-26.

Veltman. Variable-Geometry Turbochargers. Coursework for Fall 2010, http://large.stanford.edu, originally downloaded Dec. 18, 2014, 5 total pages.

Wikipedia. Variable-geometry turbocharger. Website, http://en.wikipedia.org, originally downloaded Jan. 20, 2015, 3 total pages.

* cited by examiner

COMPRESSION PERIOD 176

SCAVENGING PERIOD 175

MULTI-FUEL COMPRESSION IGNITION ENGINE

I. FIELD OF THE INVENTION

An engine having subsystems and an operating cycle configured as compared to conventional engines to meet all or a greater portion of the operational power requirements during the combustion period and not during the period in which the engine is not producing power, with the exception of the compression period and operation of an alternator.

II. BACKGROUND OF THE INVENTION

Conventional two stroke diesel engines may not be widely accepted because of operational noise, emission of particulate matter, un-burnt hydrocarbons, carbon monoxide and nitrogen oxides, and power loss due to components mechanically driven during the period in which the engine is not producing power.

There would be an advantage in providing an inventive engine having one or more inventive subsystems including or consisting of: an exhaust valve actuation system, a cam system, a fuel system, a hydraulic and lubrication system, a cooling system, and an electronic control system and an inventive method of operating the engine, or the one or more subsystems, to reduce one or more of noise, emission of particulate matter, un-burnt hydrocarbons, carbon monoxide and nitrogen oxides, or meets all or substantially all of the power demands of the engine, except for the power required for the compression period and to operate the alternator, during the combustion period of the engine cycle.

III. SUMMARY OF THE INVENTION

Accordingly, a broad object of particular embodiments of the invention can be to provide a shaft rotationally journaled in an engine which rotates through three hundred and sixty degrees of rotation by delivery of an amount of input power delivered during a combustion period (or power input period) of between about zero degrees of rotation (the piston being positioned at about top dead center) to about ninety degrees of rotation (the piston being positioned at about 90 degrees of rotation after top dead center) including one or more cams each having a fixed orientation which begin lift and end lift of a corresponding one or more cam followers to drive one or more pumps which meet all or substantially all of the operational power requirements of one or more of an exhaust valve actuation system, a fuel system, a hydraulic and lubrication system, and a cooling system within the power input period.

Another broad object of particular embodiments of the invention can be to provide one or more fluid accumulators correspondingly fluidicly coupled to one or more pumps driven within the power input period of the engine operating cycle which correspondingly store the excess fluid flow generated by the one or pumps with each of the one or more fluids exerting an amount of fluid pressure within each of said one or more accumulators which can be released with sufficient fluid pressure to meet the fluid flow needs of the engine outside of the power input period including delivery of: fuel within the fuel system, lubricating oil within the lubricating system, hydraulic oil within the hydraulic system which actuates the exhaust valves of the engine, and coolant within the cooling system.

Another broad object of particular embodiments of the invention can be to provide method of operating an engine including or consisting of: delivering an amount of input power to a shaft rotationally journaled in said engine, generating rotation of said shaft through three hundred and sixty degrees of rotation by delivery of said amount of input power, said amount of input power delivered to said shaft during an power input period coincident with a combustion period of between about zero degrees of rotation (piston positioned at about top dead center) to about ninety degrees of rotation (piston positioned at about 90 degrees of rotation after top dead center); rotating one or more cams each having a fixed orientation which begin lift and end lift of a corresponding one or more cam followers which drive one or more pumps which meet all or substantially meet all of the operational power demands of the engine during operation, with the exception of the power required for the compression period and to operate the alternator.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1B:
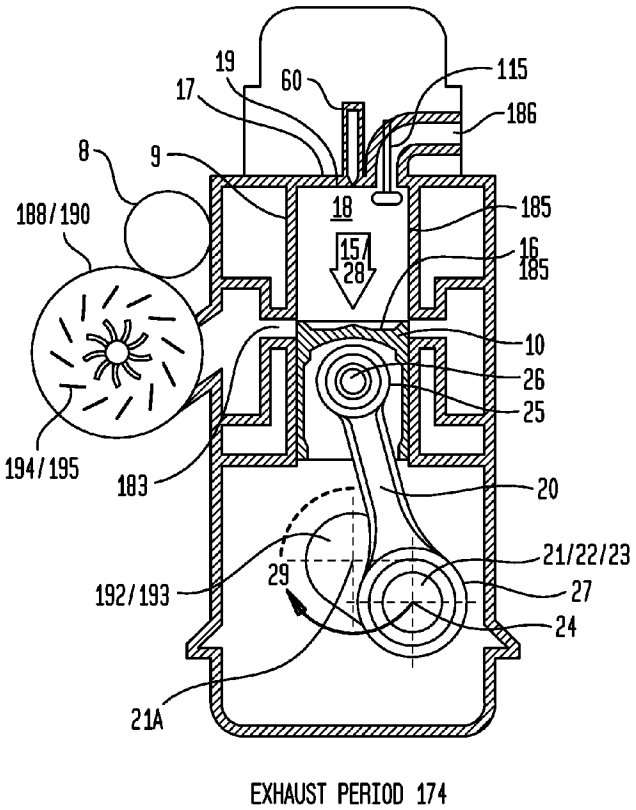
FIG. 1B is an illustrative cross sectional view of a particular embodiment of the inventive engine during the exhaust period of the engine operating cycle.

Generally referring to FIGS. 1 through 14B, which show an embodiment of the inventive engine (1) and inventive subsystems including one or more of: an exhaust valve actuation system (2), a cam system (3), a fuel system (4), a hydraulic and lubrication system (5), a cooling system (6), and an electronic control system (7) and an inventive method of operating the engine (1) or the one or more subsystems to meet all or substantially all of the power requirements of the engine (1) during the combustion period (176) of the engine cycle except for the power required for the compression period (176) and operation of the alternator (8).

Figure 1A:
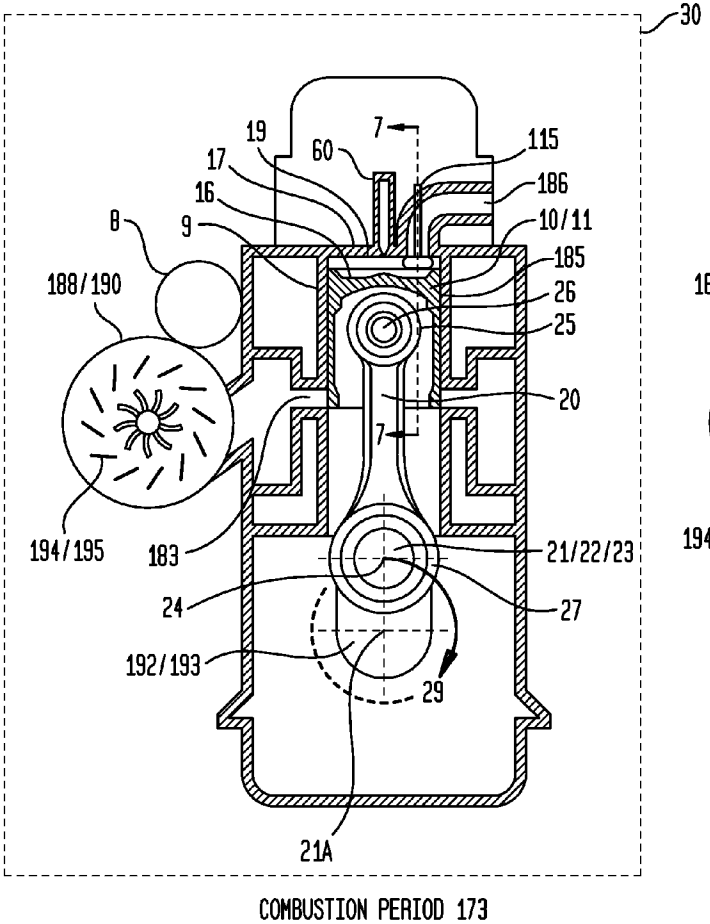
FIG. 1A is an illustrative cross sectional view of a particular embodiment of the inventive engine during the combustion period of the engine operating cycle with the engine included as part of a vehicle shown in broken line.
Figure 1D:
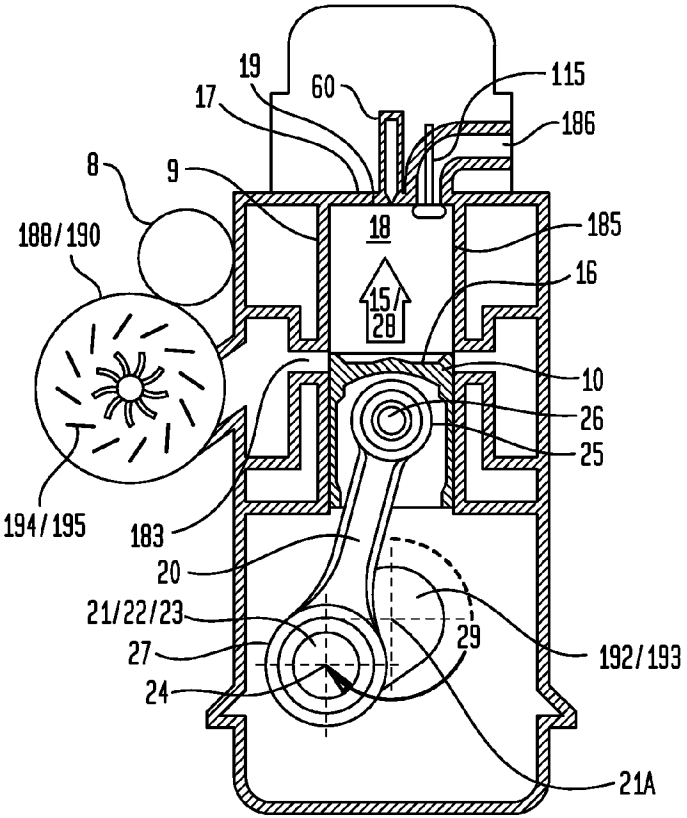
FIG. 1D is an illustrative cross sectional view of a particular embodiment of the inventive engine during the compression period of the engine operating cycle.
Figure 1C:
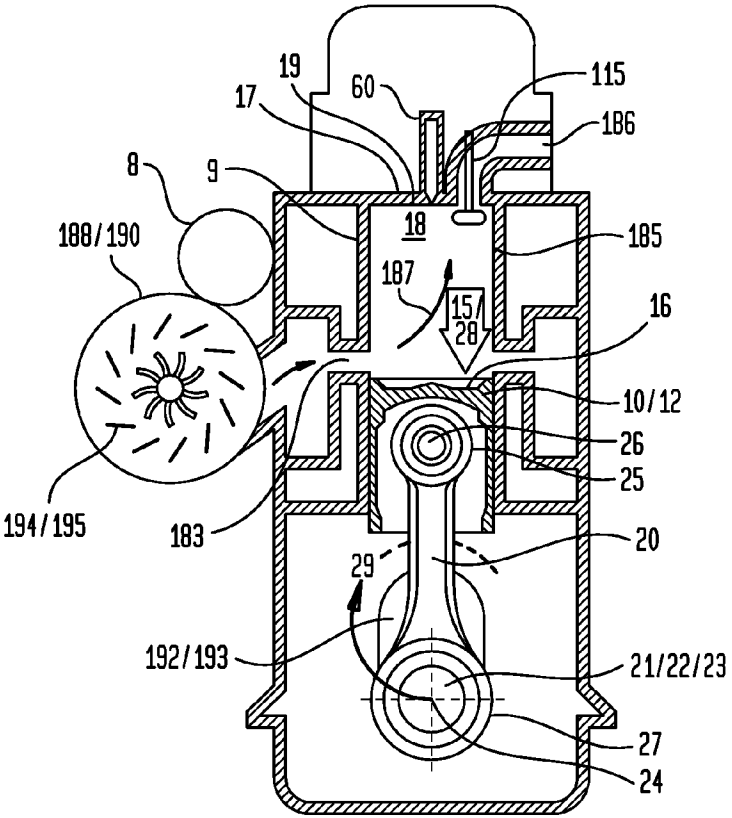
FIG. 1C is an illustrative cross sectional view of a particular embodiment of the inventive engine during the scavenging period of the engine operating cycle.
Figure 7:
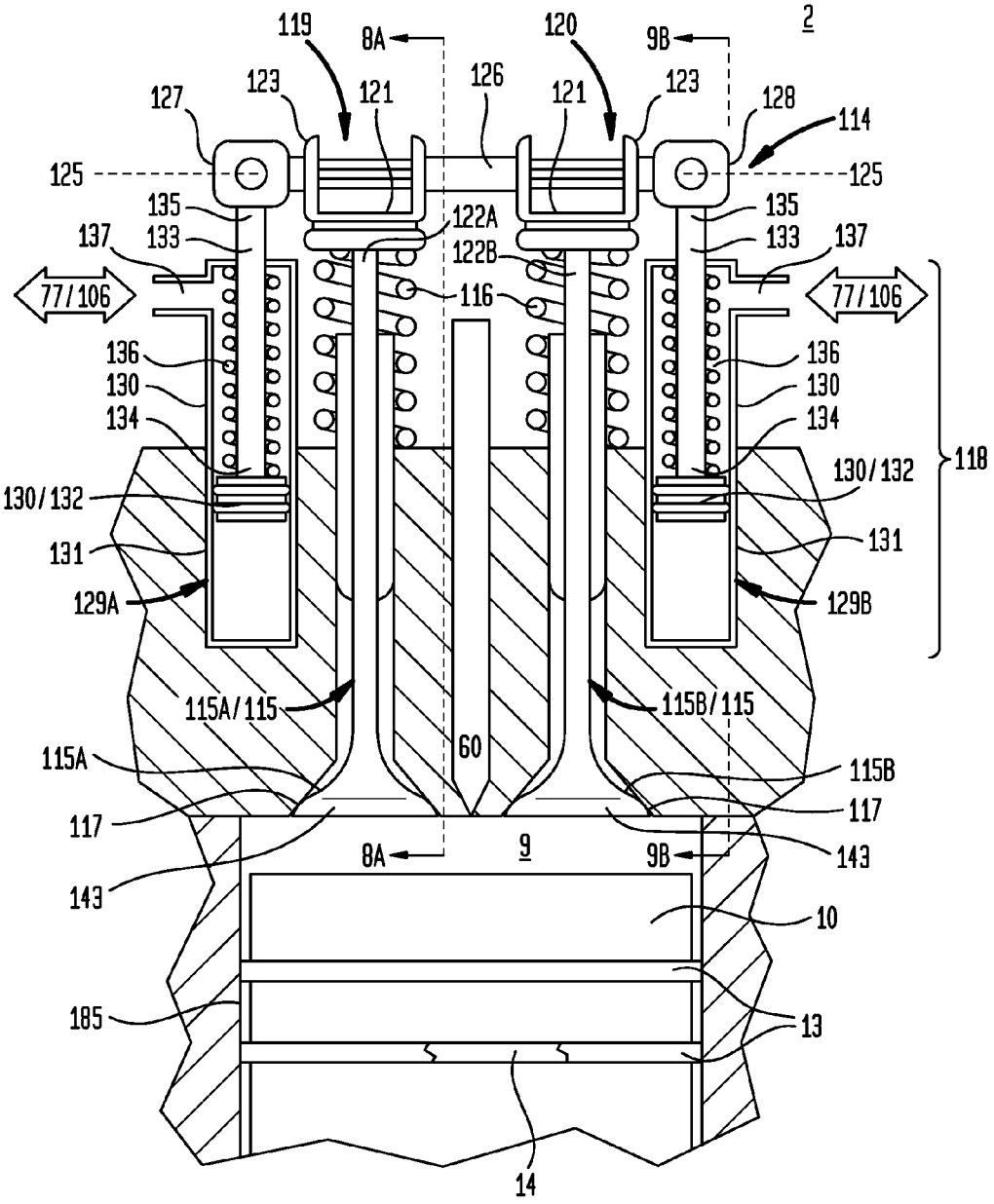
FIG. 7 is a cross section view 7-7 as shown in FIG. 1A of a particular embodiment of a valve bridge and hydraulic valve actuation assembly.

The Engine. Now referring primarily to FIGS. 1A through 1D, the engine (1) can include one or more cylinder(s) (9); although for brevity and clarity, the illustrative examples are described and shown as a one cylinder embodiment having two strokes. One or more pistons (10) can correspondingly reciprocally move a distance between a first position (11) (also referred to as "top dead center" or "TDC" as shown in the example of FIG. 1A) and a second position (12) (also referred to as "bottom dead center" or "BDC" as shown in the example of FIG. 1C) in the one or more cylinder(s) (9). The distance between the first position (11) and the second position (12) can vary depending upon the embodiment and application of the invention. The slidably mated surfaces of the cylinder (9) and the piston (10) can be engaged in whole or in part whether directly or indirectly by two or more annular rings (13) fitted in corresponding annular grooves (14) of the piston (10) (as shown in the example of FIG. 7); although the invention is not necessarily so limited. The piston (10) can be sufficiently sealed against the corresponding cylinder (9) to allow pressure (15) acting on the piston face (16) to correspondingly generate travel of the piston (10) in the cylinder (9) between the first position (11)(top dead center) and the second position (12) (bottom dead center). A cylinder head (17) can be joined to the cylinder (9) to define a combustion chamber (18) between a cylinder head face (19) and the piston face (16).

The reciprocating linear movement (28) of the piston (10) can be converted to a rotational movement (29) through a connecting rod (20) and a crankshaft (21). The crankshaft (21) includes a crank throw (22) including a crank throw bearing journal (23) having a crank throw axis (24) offset from the crankshaft axis (21A) of the crankshaft (21). A connecting rod first end (25) connects to a piston pin (26) which allows the connecting rod (20) to swivel in relation to the piston (10). A connecting rod second end (27) of the connecting rod (20) connects to the crank throw bearing journal (23) of the crank throw (22) which allows the crank throw (22) to rotate within the connecting rod second end (27). Because the connecting rod first and second ends (25)(27) rotate about the piston pin (26) and the crank throw (22), the angle between the connecting rod (20) and the piston (10) can change as the connecting rod (20) moves up and down and rotates around the crank throw (22). As the piston (10) moves inside the cylinder (9), the reciprocal linear movement (28) of the piston (10) can be converted into rotational or circular motion (29) of the crankshaft (21). The rotational motion (29) can be used to perform useful work such as propel a vehicle (30)(shown in FIG. 1A as a block in broken line).

The Fuel System. Now referring primarily to FIG. 2, in the fuel system (4), fuel (31) can flow from a fuel tank (32)(which can, but need not necessarily, be by operation of a manual primer (33)) prior to engine (1) start up) through a primary fuel filter (34) to a low pressure fuel pump (35). The low pressure fuel pump (35) can, but need not necessarily, be a spring-loaded plunger fuel pump (36)(as illustratively shown in the example of FIG. 3) having a low pressure fuel inlet check valve (37) and a low pressure fuel outlet check valve (38), as further described below. The low pressure fuel pump (35)(36) can have a low pressure fuel pump plunger (39) which travels in a low pressure fuel pump barrel (40). The low pressure fuel pump plunger (39) can be made responsive to a low pressure fuel pump spring (41). The low pressure fuel pump plunger (39) can be operationally coupled to a low pressure fuel pump cam follower (42) which engages a low pressure fuel pump cam (43), as further described below. A low pressure fuel pump cam follower spring (42A) which can be coiled about the low pressure fuel pump plunger (39) can urge the low pressure fuel pump cam follower (42) against a low pressure fuel pump cam (43), as further described below, to insure that that the low pressure fuel pump cam follower (42) follows the contour of the low pressure fuel pump cam (43). The low fuel pressure (44) can be adjusted by operation of a low fuel pressure adjustment element (45) which alters the low pressure fuel pump spring compression load (45A) of the low pressure fuel pump spring (41) responsive to operation of the low pressure fuel pump plunger (39). An exemplary low pressure fuel pump (35)(36) can be a Bosch, Model PE diesel engine fuel supply pump. The low pressure fuel pump (35)(36) generates a flow of fuel (31) which can be maintained at a low fuel pressure (44) of between about 25 pounds per square inch ("psi") to about 150 psi which can be incrementally adjusted by operation of the low fuel pressure adjustment element (45) in 1 psi increments throughout the low fuel pressure (44) range depending on the application. A low fuel pressure (44) suitable for particular embodiments of the invention can be about 100 psi. The low pressure fuel pump (35)(36) can deliver the flow of fuel (31) through a secondary fuel filter (46) and then through a fuel pressure reducing valve (47), a variable restriction fuel metering valve (49), a high pressure fuel inlet check valve (48), to a high pressure fuel pump (50).

Figure 4:
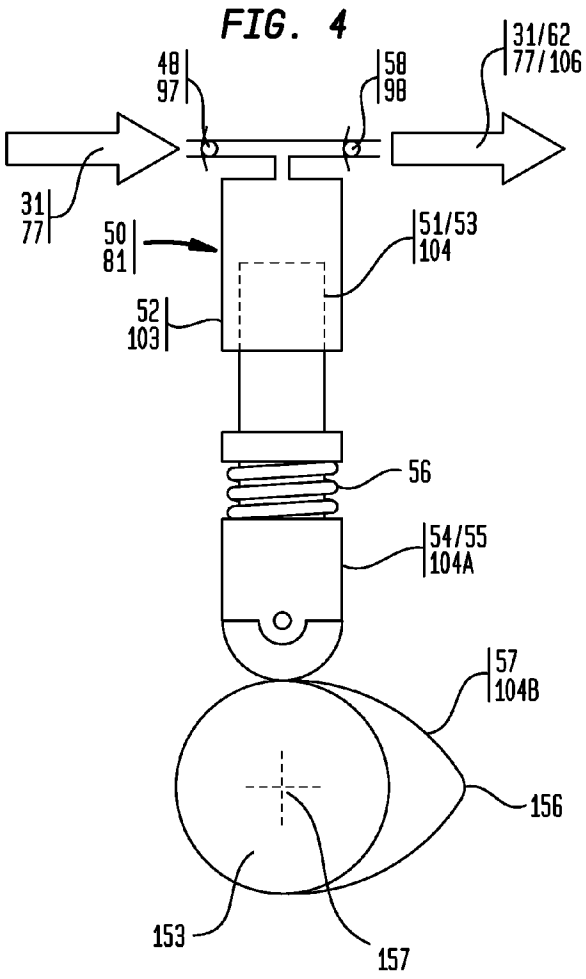
FIG. 4 is an illustrative diagram of a high pressure pump actuated by a cam follower engaged with the camming surface of a cam.
Figure 3:
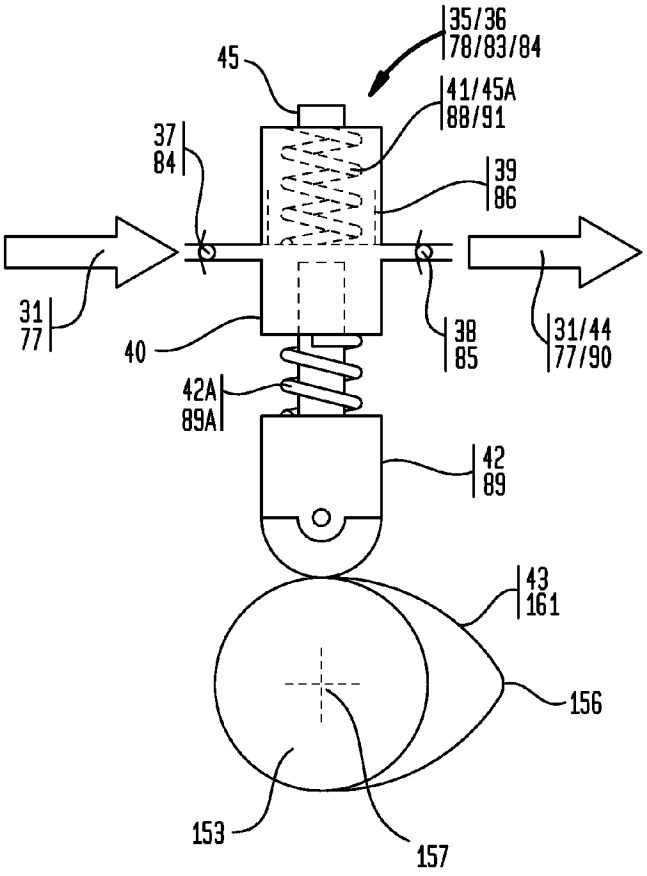
FIG. 3 is an illustrative diagram of a low pressure pump actuated by a cam follower engaged with the camming surface of a cam.
Figure 5B:
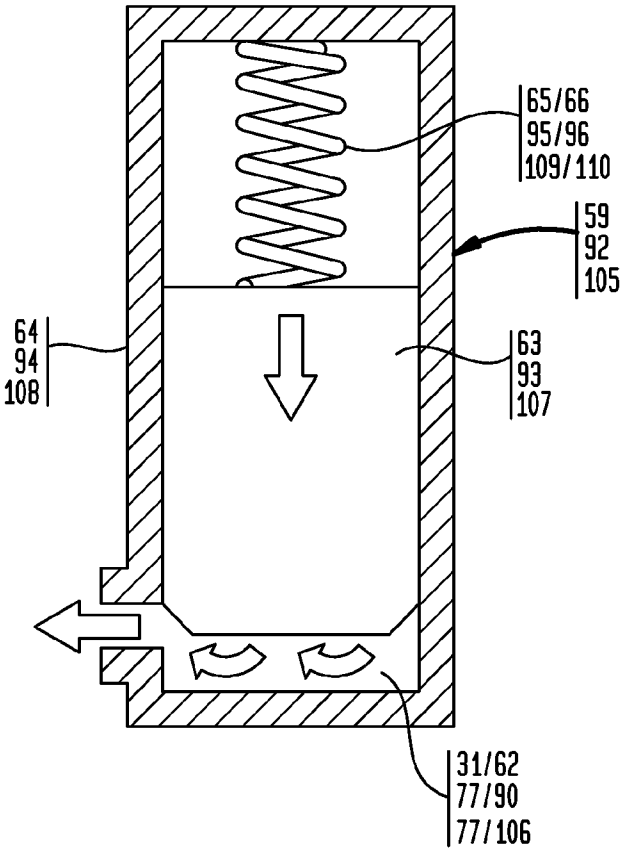
FIG. 5B is an illustrative cross sectional view of a particular embodiment of fluid accumulator delivering a fluid flow at a fluid pressure corresponding to the compression load of the accumulator spring.
Figure 5A:
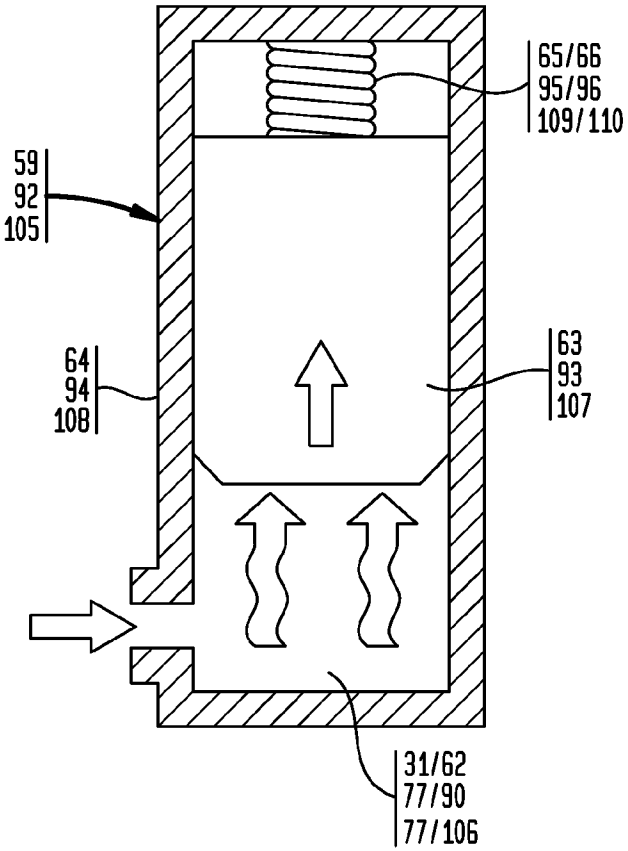
FIG. 5A is an illustrative cross sectional view of a particular embodiment of a fluid accumulator receiving a fluid flow from a high pressure or low pressure pump causing compression of an accumulator spring.

As to particular embodiments, the high pressure fuel pump (50) can include a high pressure fuel pump plunger (51) which travels in a high pressure fuel pump barrel (52). The high pressure fuel pump plunger (51) can, but need not necessarily, be a free floating high pressure fuel pump plunger (53) (as shown in the illustrative example of FIG. 4)

which does not need to stroke every time the associated high pressure fuel pump cam follower (54) begins another lift. The high pressure fuel pump cam follower (54)(which can, but need not necessarily be, a roller lifter (55) as shown in the example of FIG. 4) can be telescopingly engaged to the high pressure fuel pump plunger (51) of the high pressure fuel pump (50). A cam follower spring (56) which can be coiled about the high pressure fuel pump plunger (51) can urge the high pressure fuel pump cam follower (54)(55) against a high pressure fuel pump cam (57), as further described below, to insure that that the high pressure fuel pump cam follower (54)(55) follows the contour of the high pressure fuel pump cam (57); although, the free floating high pressure fuel pump plunger (51) need not necessarily be forced to follow. The plunger stroke is determined by the amount of fuel (31) metered to the high pressure fuel pump (50) by the variable restriction fuel metering valve (49). The variable restriction fuel metering valve (49) and free floating high pressure fuel pump plunger (51) can, for example, perform the same as the corresponding components used in rotary injection pumps built by Stanadyne, Model DB2. The high pressure fuel pump (50) delivers fuel (31) through a high pressure fuel outlet check valve (58) into a high pressure fuel accumulator (59)(as shown in the example of FIGS. 5A and 5B) through a high pressure accumulator outlet check valve (59A) fluidicly connected to a fuel injector (60) or a common injector rail (61) (shown in broken line) fluidicly coupled to the cylinder(s)(9) of the engine (1).

The high pressure fuel pump (50) can develop a high fuel pressure (62) which can be delivered to a high pressure fuel accumulator (59). The high pressure fuel pump (50) and the high pressure fuel accumulator (59) can develop a high fuel pressure (62) in a range of between 10,000 psi to about 50,000 psi which can be incrementally adjusted in 100 psi increments through the range (for example, 10,000 psi, 10,100 psi, 10,200 psi . . . ) depending upon the application. As to particular embodiments, the volume of fuel (31) that the variable restriction fuel metering valve (49) delivers into the high pressure fuel pump (50) determines the periodicity and length of the stroke of the high pressure fuel pump plunger (51) and the amount of fuel (31) delivered into the high pressure fuel accumulator (59) is determined by the amount of fuel (31) having high fuel pressure (62) in the high pressure fuel accumulator (59). Embodiments of the high pressure fuel accumulator (59) can, but need not necessarily include, a high pressure fuel accumulator piston (63) which travels within a high pressure fuel accumulator cylinder (64). The high pressure fuel accumulator piston (63) can be made responsive to a high fuel pressure accumulator spring (65) compressed by the delivery of fuel (31) at sufficiently high fuel pressure (62) allowing travel of the accumulator piston (63) within the accumulator cylinder (64). The high fuel pressure (62) can be adjusted by changing the high fuel pressure accumulator spring compression load (66) of the high fuel pressure accumulator spring (65).

The high fuel pressure (62) in the high pressure fuel accumulator (59) can be, but is not necessarily, controlled by a variable restriction fuel metering valve (49). The variable restriction fuel metering valve (49) can include a fuel metering valve needle (67A) which sealably engages a fuel metering valve seat (67B). The fuel metering valve needle (67A) can further include a fuel metering piston (68A) which travels in a fuel metering valve cylinder (68B). The fuel metering valve needle (67A) can be held in the open position by action of a fuel metering spring (68C) which opposes travel of the fuel metering piston (68A) in the fuel metering valve cylinder (68B). The fuel metering piston (68A) can be fludicly coupled to the high fuel pressure (62) in the high pressure fuel accumulator (59). When the high fuel pressure (62) in the high pressure fuel accumulator (59) overcomes the fuel metering spring compression load (66), the fuel metering valve needle (67A) sealably engages the fuel metering valve seat (67B) interrupting the flow of fuel (31) to the high pressure pump (50). Due to the operation of the free floating high pressure fuel pump plunger (53) in the high pressure pump (50), no fuel (31) will be pumped and the high fuel pressure (62) does not rise the high pressure accumulator (59). Conversely, when the high fuel pressure (62) falls below the fuel metering spring compression load (66), the spring loaded fuel metering piston (68A) can lift the fuel metering valve needle (67A) off of fuel metering valve seat (67B) allowing fuel (31) to flow to the high pressure pump (50). The amount of fuel (31) that flows to the high pressure pump (50) depends upon the amount of change in the high fuel pressure (62) and the distance the fuel metering valve needle (67A) is lifted off of the fuel metering valve seat (67B). The amount of fuel (31) that flows to the high pressure pump (50) determines the length of the stroke of the free floating high pressure fuel pump plunger (53) in the high pressure fuel pump (50). The fuel metering spring compression load (68D) (and maximum accumulator pressure) can be adjusted by changing or shimming the fuel metering spring (68C).

Figure 13:
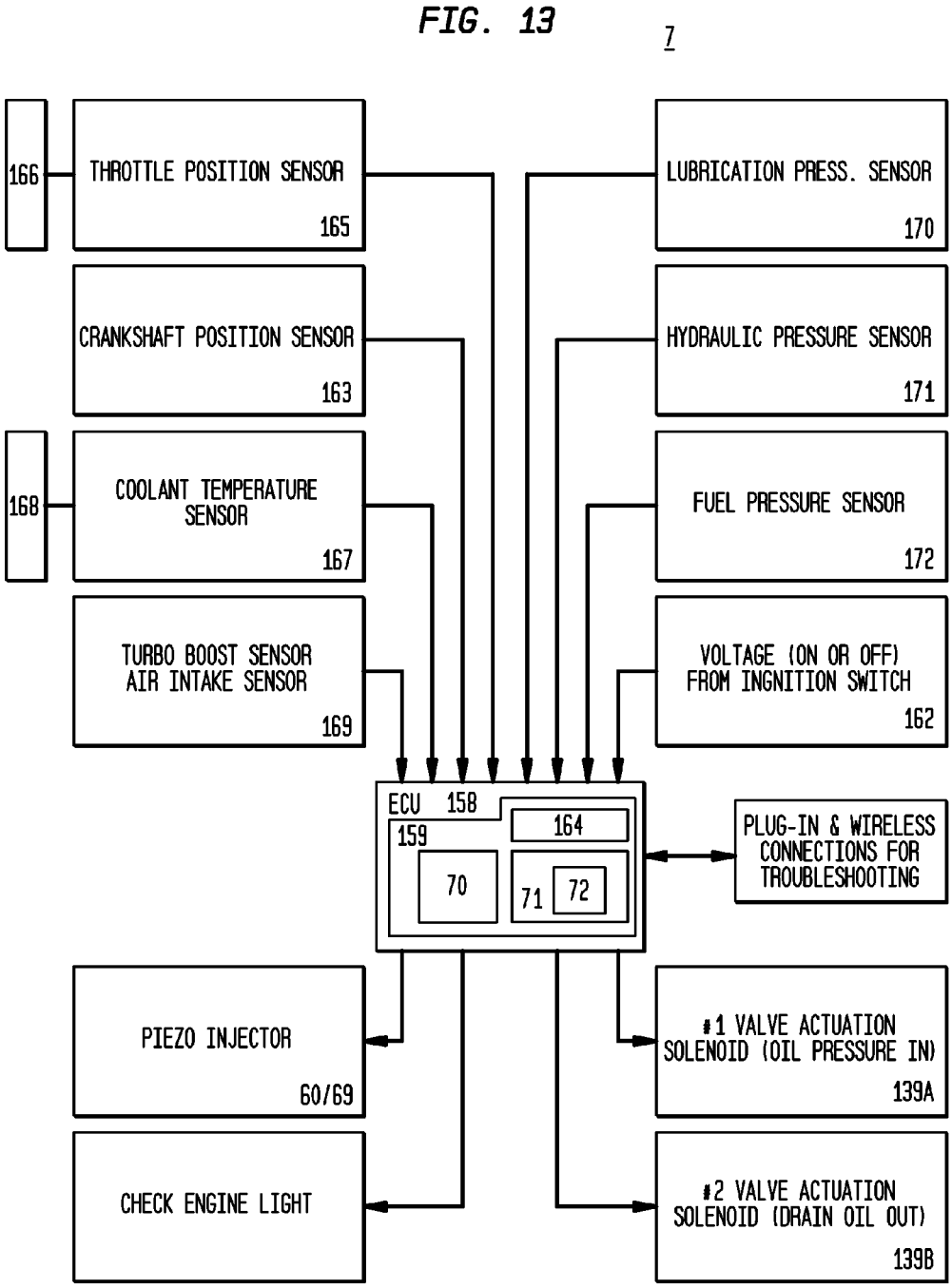
FIG. 13 is an illustrative block diagram of an electronic control system which senses and controls one or more of the electrical systems or subsystems of an embodiment of the engine or a vehicle.
Figure 14B:
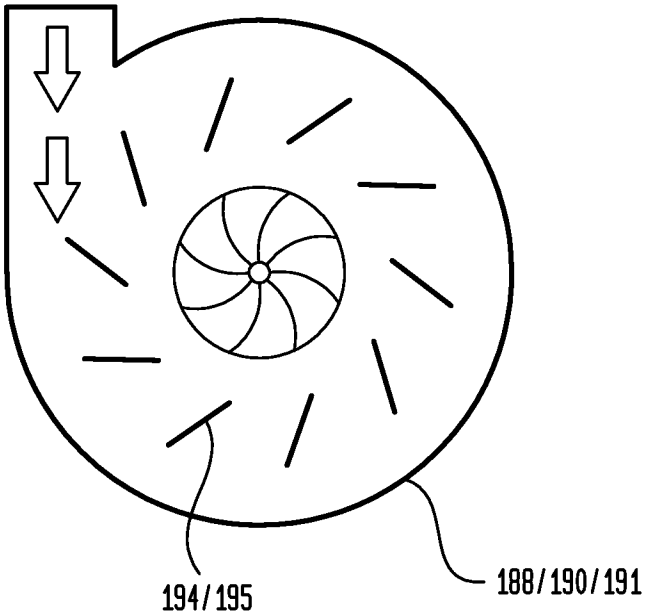
FIG. 14Bis an illustrative diagram of a variable geometry turbochargers which can be fluidicly coupled to the air intake of particular embodiments of the engine with the vane angle or vane height adjusted to operate at higher engine RPM.
Figure 14A:
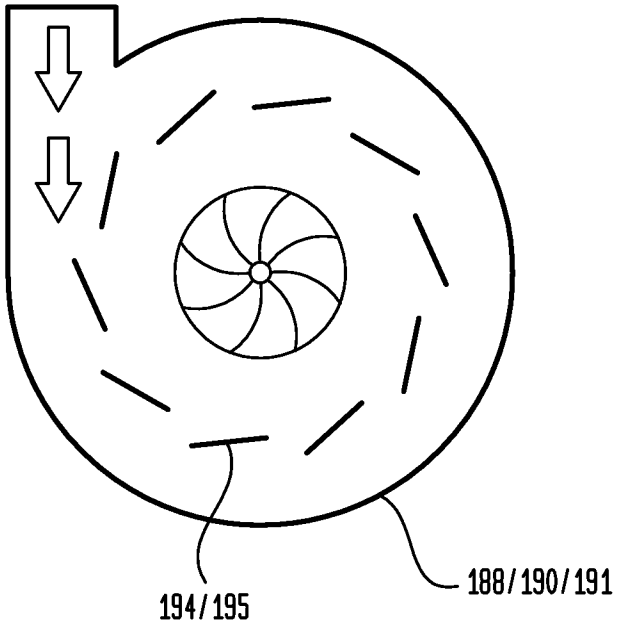
FIG. 14A is an illustrative diagram of a variable geometry turbocharger which can be fluidicly coupled to the air intake of particular embodiments of the engine with the vane angle or vane height adjusted to operate at lower engine RPM.

The fuel injectors (60)(which can, but need not necessary be, piezo fuel injectors (69)) can be controlled by an ECU (158)(as shown in the example FIG. 13). The ECU (158) at least includes an ECU processor (70) in communication with an ECU memory element (71) containing an electronic control program (72) which can be executed to control the fuel injector (60)(69) to inject fuel (31) into the combustion chamber (18) during each combustion period (173) in the engine operating cycle (141). A fuel relief valve (73) can be located between the high pressure fuel pump (50) and the high pressure fuel accumulator (59) to return excess fuel (31) back to the fuel tank (32) and to allow air (74) entrapped in the fuel system (4) to bleed to the ambient environment (75).

The Hydraulic and Lubrication System. Now referring primarily to FIG. 6, the hydraulic and lubrication system (5) includes an oil reservoir (76) containing an amount of oil (77). A low pressure oil pump (78) disposed in a low pressure lubrication side (79) of the hydraulic and lubrication system (5) operably generates a flow of oil (77) through a low pressure oil filter (80) to lubricate the engine (1) and to a high pressure oil pump (81) which generates a flow of oil (77) in a high pressure hydraulic side (82) of the hydraulic and lubrication system (5). In the low pressure lubrication side (79), the low pressure oil pump (78) (and a second low pressure oil pump (78A) of similar configuration can be used with dry sump embodiments) can, but need not necessarily be, a spring loaded plunger low pressure oil pump (83)(as shown in the illustrative example of FIG. 3 and can be similar to the spring-loaded plunger fuel pump (36)) including a low pressure oil inlet check valve (84) and an oil outlet check valve (85). The low pressure oil pump (78) can have a low pressure oil pump plunger (86) which travels in a low pressure oil pump barrel (87). The low pressure oil pump plunger (86) can be made responsive to a low pressure oil pump spring (88). The low pressure oil pump plunger (86) can be operationally coupled to a low pressure oil pump cam follower (89) which engages a low pressure oil pump cam (161), as further described below. A low oil pressure (90) can be adjusted by changing the low pressure oil pump spring compression load (91) of the low pressure oil pump spring (88) engaging the low pressure oil pump plunger (86). A low pressure fuel pump cam follower spring (89A) which can be coiled about the low pressure oil pump plunger (86) can urge the low pressure oil pump cam follower (89) against a low pressure oil pump cam (161), as further described below, to insure that that the low pressure oil pump cam follower (89) follows the contour of the low pressure oil pump cam (161). The low oil pressure (90) can be adjusted by operation of a low oil pressure adjustment element (91) which alters the low pressure fuel pump spring compression load (91A) of the low pressure oil pump spring (88) responsive to operation of the low pressure fuel pump plunger (86). The low pressure oil pump (78) can deliver oil (77) to a low pressure oil accumulator (92) at low oil pressure (90) in a range of about 25 psi to about 80 psi depending upon the application. The low pressure oil pump spring compression load (91A) can be adjusted in about 1 psi increments over the entire range of low oil pressure (90).

As one illustrative example, the low pressure oil pump (78) and the low pressure oil accumulator (92) can develop a low oil pressure (90) of about 50 psi. The low pressure oil accumulator (92) can be configured and operate in a manner similar to the high pressure fuel accumulator (59) above described, having a low pressure oil accumulator piston (93) which travels in a low pressure oil accumulator cylinder (94). A low pressure oil accumulator spring (95) responsive to travel of the low pressure oil accumulator piston (93) can have a pre-determined low pressure oil accumulator spring compression load (96) which maintains low oil pressure (90) within the low pressure oil accumulator (92).

The low pressure lubrication side (79) of the hydraulic and lubrication system (5) also delivers oil (77) to the high pressure hydraulic side (82) of the hydraulic and lubrication system (5) to a high pressure oil pump (81) having a high pressure oil inlet check valve (97) and a high pressure oil outlet check valve (98). Prior to the high pressure oil inlet check valve (97) and on a separate low pressure lubrication branch (99) including a fixed volume restrictor (100), a low pressure lubrication branch electrically actuated solenoid (101) can open to supply oil (77) to the engine (1) at start-up and operation of the engine (1).

The high pressure hydraulic side (82) of the hydraulic and lubrication system (5) includes a high pressure oil pump (81) having a high pressure oil pump plunger (102) that travels in a high pressure oil pump barrel (103) similar to the description for the high pressure fuel pump (50); although the high pressure oil pump (81) can have a higher oil volume and generates a lower oil pressure as compared to the fuel volume and the fuel pressure generated by the high pressure fuel pump (50). The high pressure oil pump (81) can have a floating high pressure oil pump plunger (104) responsive to a high pressure oil pump cam follower (104A) which follows the contours of a high pressure oil pump cam (104B); however, the floating high pressure oil pump plunger (104) need not necessarily be forced to follow.

The high pressure oil pump (81) can deliver oil (77) to a high pressure oil accumulator (105) at high oil pressure (106) in a range of about 2,500 psi to about 5,000 psi depending upon the application. The high pressure oil accumulator (105) can be configured and operate in a manner similar to the high pressure fuel accumulator (59) above described, having a high pressure oil accumulator piston (107) which travels in a high pressure oil accumulator cylinder (108). A high pressure oil accumulator spring (109) responsive to travel of the high pressure oil accumulator piston (107) can have a pre-determined high pressure oil accumulator spring compression load (110) which maintains high oil pressure (106) within the high pressure oil accumulator (105). The high pressure oil accumulator spring compression load (110) can be adjusted in about 100 psi increments over the entire range of high oil pressure (106). As one illustrative example, the high pressure oil pump (81) and the high pressure oil accumulator (105) can develop a high oil pressure (106) of about 4,000 psi.

As to particular embodiments, the high pressure hydraulic side (82) of the hydraulic and lubrication system (5) can, but need not necessarily, include a variable restriction oil metering valve (111) arranged to function in manner similar to the corresponding components associated with the high pressure fuel pump (50). The high oil pressure (90) in the high pressure oil accumulator (105) can be, but is not necessarily, controlled by a variable restriction oil metering valve (111). The variable restriction oil metering valve (111) can include an oil metering valve needle (112A) which sealably engages an oil metering valve seat (112B). The oil metering valve needle (112A) can further include an oil metering piston (113A) which travels in an oil metering valve cylinder (113B). The oil metering valve needle (112A) can be held in the open position by action of a oil metering spring (113C) which opposes travel of the fuel metering piston (113A) in the fuel metering valve cylinder (113B). The fuel metering piston (113A) can be fludicly coupled to the high oil pressure (90) in the high pressure oil accumulator (105). When the high oil pressure (90) in the high pressure oil accumulator (105) overcomes the oil metering spring compression load (113D), the oil metering valve needle (112A) sealably engages the fuel metering valve seat (112B) interrupting the flow of oil (77) to the high pressure oil pump (81). Due to the operation of the free floating high pressure oil pump plunger (104) in the high pressure pump (81), no oil (77) will be pumped and the high oil pressure (90) does not increase in the high pressure accumulator (105). Conversely, when the high oil pressure (90) falls below the oil metering spring compression load (113D), the spring loaded oil metering piston (113A) can lift the oil metering valve needle (112A) off of the oil metering valve seat (112B) allowing oil (77) to flow to the high pressure oil pump (81). The amount of oil (77) that flows to the high pressure pump (81) depends upon the amount of change in the high oil pressure (90) and the distance the oil metering valve needle (112A) is lifted off of the oil metering valve seat (112B). The amount of oil (77) that flows to the high pressure oil pump (81) determines the length of the stroke of the free floating high pressure oil pump plunger (104) in the high pressure fuel pump (81). The oil metering spring compression load (113D) (and maximum accumulator pressure) can be adjusted by changing or shimming the fuel metering spring (113C).

The high pressure oil pump (81) and high pressure oil accumulator (105) can deliver high oil pressure (106) through a high pressure oil accumulator outlet check valve (105A) to a hydraulic valve actuation assembly (118) which operates one or more exhaust valves (115)(or other components) during operation of the engine (1).

The Exhaust Valve Actuation System. Now referring primarily to FIGS. 7 through 9, each cylinder (9) includes one or more exhaust valves (115). In the embodiment shown in the Figures, the cylinder (9) includes four exhaust valves (115) which can, but need not necessarily, open and close simultaneously. The exhaust valves (115) can be closed by exhaust valve springs (116) that correspondingly bias the exhaust valves (115) against the valve seats (117). The exhaust valves (115) can be held closed by exhaust valve springs (116) which can, but need not necessarily, have greater resistance to compression loads than conventional valve springs, aided by compression and combustion pressures developed in the cylinders (9) during operation of the engine (1).

Figure 6:
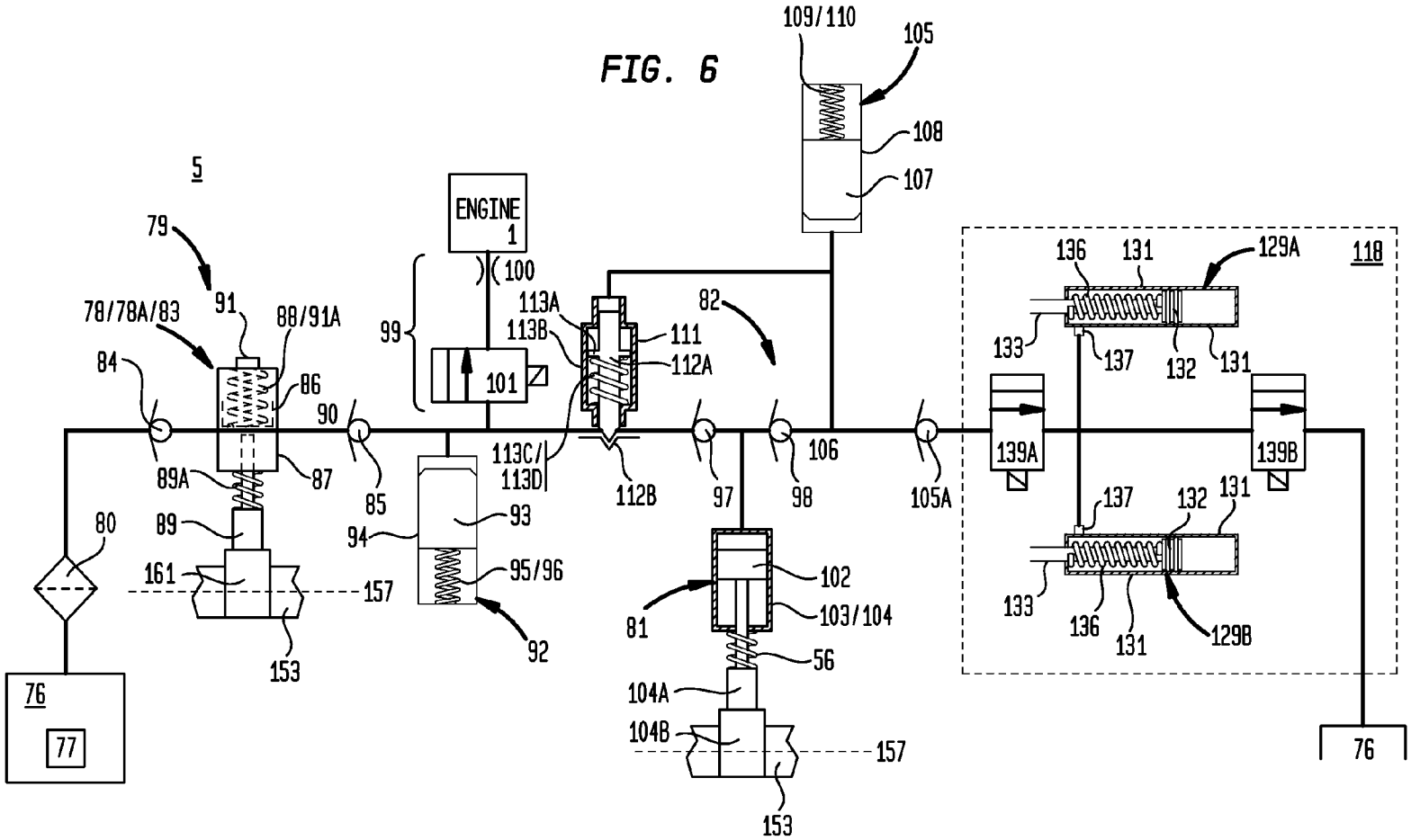
FIG. 6 is an illustrative block diagram of a hydraulic and lubrication system of a particular embodiment of the inventive engine.
Figure 8:
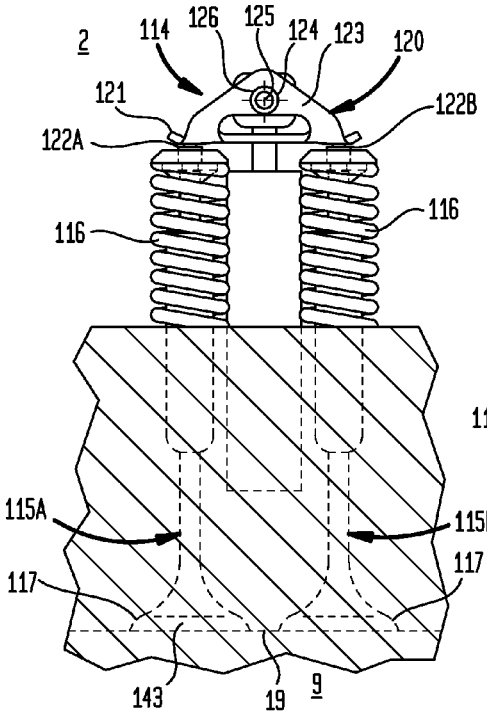
FIG. 8 is a cross section view 8-8 as shown in FIG. 7 of a particular embodiment of a valve bridge and hydraulic valve actuation assembly.
Figure 9:
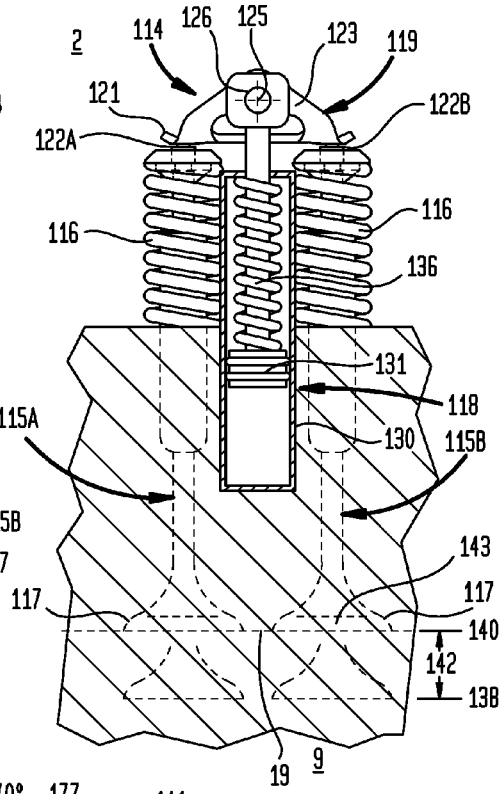
FIG. 9 is a cross section view 9-9 as shown in FIG. 7 of a particular embodiment of a valve bridge and hydraulic valve actuation assembly.

The exhaust valves (115) can, but need not necessarily, be opened by an exhaust valve actuation system (2) including a bridge actuation assembly (114) responsive to a hydraulic valve actuation assembly (118)(also shown in the example of FIG. 6). In the embodiment, which includes four exhaust valves (115) associated with one cylinder (9), the bridge actuation assembly (114) includes two valve bridges (119)(120)(as shown in the example of FIGS. 7-9). Each valve bridge (119)(120) includes a bridge element (121) configured to concurrently engage the valve stem ends (122A and 122B) of a pair of valves (115A)(115B)(as shown in the examples of FIGS. 8 and 9) and a pair of bridge flanges (123) upwardly extending from the bridge element (121) each pair of bridge flanges (123) having a medially disposed aperture element (124) which defines a pivot axis (125) for each of the valve bridges (119)(120). A pivot element (126) passes through the aperture element (124) of each bridge flange (123) allowing each valve bridge (119)(120) to pivot about the pivot element (126). The pivot element (126) has a length disposed between a pair of pivot element ends (127)(128) which are acted upon by the a hydraulic valve actuation assembly (118) to move the two valve bridges (119)(120) to correspondingly compress the four valve springs (116) to open the four valves (115).

The hydraulic valve actuation assembly (118), in the embodiment having four exhaust values (115) per cylinder (9), includes a pair of hydraulic actuators (129A)(129B) each having a hydraulic actuator plunger (130) which travels in a hydraulic actuator barrel (131). The hydraulic actuator plunger (130) can include a hydraulic plunger head (132) fluidicly sealably engaged to the hydraulic actuator barrel (131) and a hydraulic plunger stem (133) having a stem length disposed between a hydraulic plunger stem first end (134) coupled to or directly coupled to the hydraulic plunger head (132) and a hydraulic plunger stem second end (135) configured to pivotally couple to a corresponding one of a pair of pivot element ends (127)(128). Each hydraulic actuator (129A)(129B) can, but need not necessarily, include an actuator spring (136) to bias travel of the plunger head (132) to correspondingly bias each valve bridge (119)(120) against a pair of valve stem ends (122A)(122B). Each hydraulic actuator barrel (1310) has an inlet-outlet element (137) for ingress and egress of oil (77). The oil (77) can be have a high oil pressure (106) to generate travel of the hydraulic actuator plunger (130) in the corresponding hydraulic actuator barrel (131) to compress each of the four valve springs (116) to move the four exhaust valves (115) toward an exhaust valve open condition (138)(as shown in the example of FIG. 9).

The bridge actuation assembly (114) adjusts to substantially zero or to zero the clearance between the bridge element (121) and the corresponding pair valve stem ends (122A)(122B) due to the configuration the bridge actuation assembly (114) which operably allows front to back and side to side pivoting and the use of the actuator springs (136) which maintain pressure of each of the bridge elements (121) against the pair valve stem ends (122A)(122B).

Operation of the bridge actuation assembly (114) can, but need not necessary, be controlled by opening and closing of hydraulic actuator valves (139A)(139B), which can but need not necessarily be, electric solenoid valves. A first hydraulic actuator valve (139A) can open to allow a flow of oil (77) ingress to the inlet-outlet element (137) of the actuator barrels (131) of both of the hydraulic actuators (129A)(129B) to move the exhaust valves (115) toward the exhaust valve open condition (138)(as shown in the example of FIG. 8). A second hydraulic actuator valve (139B) can open to allow a flow of oil (77) egress from the inlet-outlet element (137) of the actuator barrels (131) of both hydraulic actuators (129A)(129B) to move the exhaust valves (115) toward the exhaust valve closed condition (140)(as shown in the example of FIGS. 7 and 8). As to particular embodiments of the hydraulic actuator valves (139A)(139B), such as electric solenoid valves, the operation can be controlled by the ECU (158). The ECU (158) can operate the hydraulic actuator valves (139A)(139B) to control the time period in which each exhaust valve (115) is in the exhaust valve open condition (138) and the exhaust valve closed condition (140) to control within the engine operational cycle (141) the duration of time in which the each of the four exhaust valves (115) remains in the exhaust valve open condition (138) and the exhaust valve closed condition (140) and the amount of exhaust valve lift (142) (the distance of a valve head (143) from the valve seat (117)).

Figure 10:
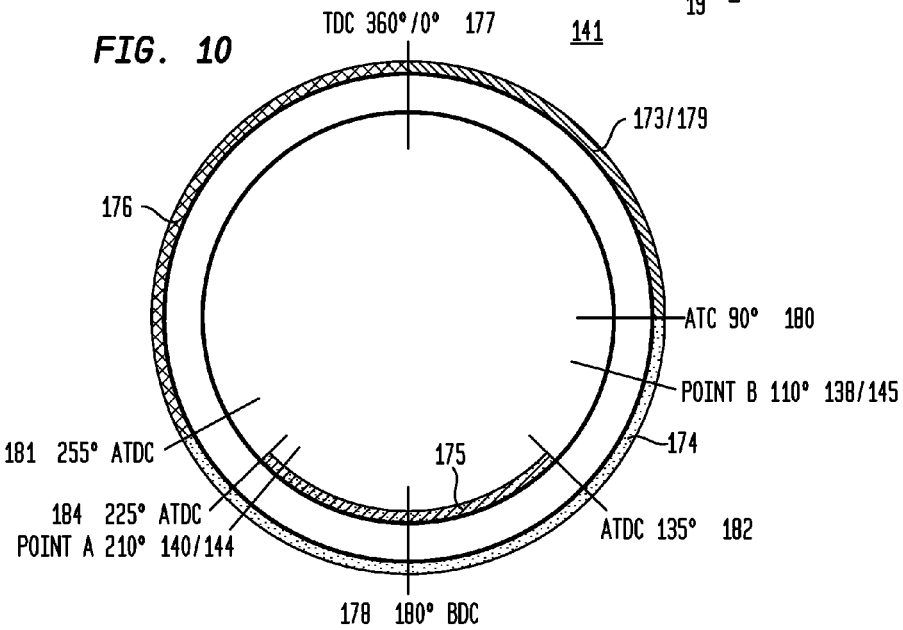
FIG. 10 is an illustrative diagram of the operating cycle of a particular embodiment of the inventive engine.
Figure 11:
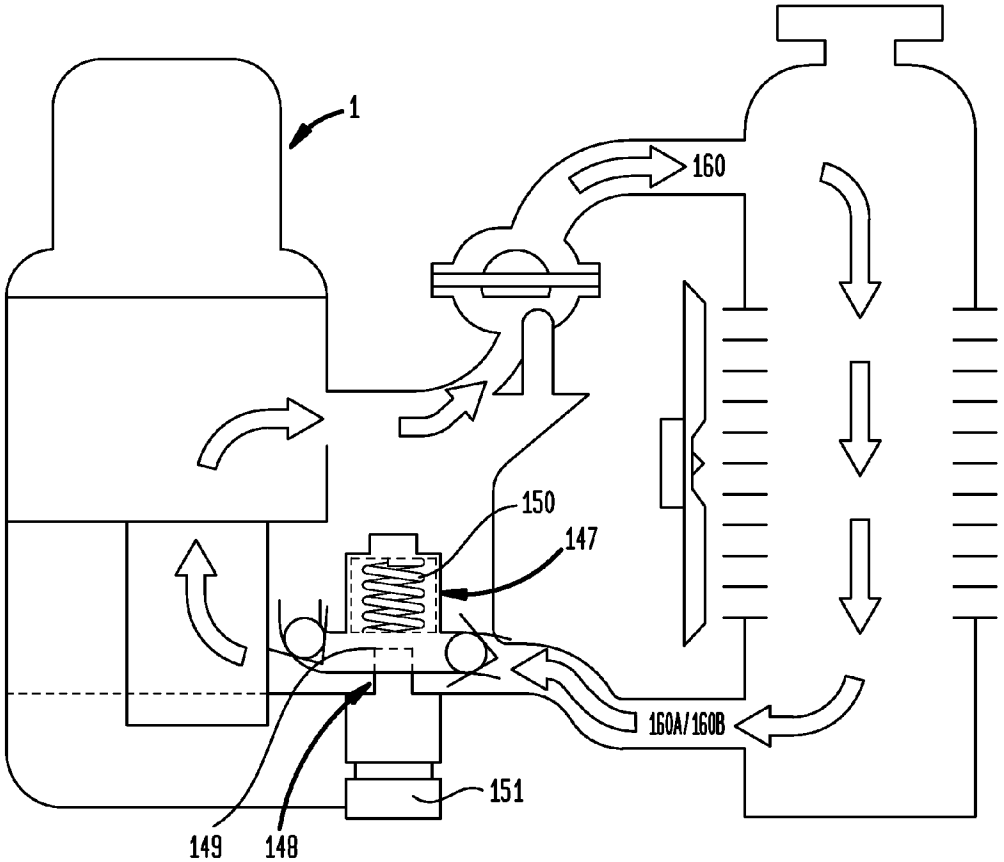
FIG. 11 is an illustrative diagram of a cooling system of a particular embodiment of the inventive engine.

Now referring primarily to FIG. 10, the exhaust valve closed condition (140) can, but need not necessarily, occur as early as Point A (144) (about 210° ATDC) and the exhaust valve open condition (138) can, but need not necessarily, occur as late as Point B (145) (about 110° ATDC). The variable timing of the exhaust valve open and closed condition (138)(140) within the engine operating cycle (141), the variable duration of the exhaust valve open and closed condition (138)(140) within the engine operational cycle (141), and the variable amount of exhaust valve lift (142) provides substantial advantages over conventional engine configurations. As illustrative examples, upon initial rotation of the engine crankshaft (21), the four exhaust valves (115) can be established in the exhaust valve open condition (138) having only slight exhaust valve lift (142) acting to release gases in the combustion chamber (18) reducing forces of compression to allow relatively free rotation of the engine crankshaft (21). Upon reaching a pre-selected crankshaft (21) rounds per minute ("RPM"), the exhaust valve closed condition (140) and the exhaust valve open condition (138) can for example occur at Point A (144) and Point B (145) respectively, but with only slight exhaust valve lift (142); although the duration can be adjusted depending upon the application. The four exhaust valves (115) can move to the close condition at about Point A (144) in the engine operating cycle (141) in order to allow for a lesser amount of air (74) to egress from the combustion chamber (18) and to allow for a greater period of time for the compression period (176). While this would shorten the time for the scavenging period (175) during the engine operating cycle (141), this would not be detrimental during engine start-up and would afford a 'supercharged air' effect. Opening the four exhaust valves (115) at about Point B (145), affords a greater period of time for the combustion period (173) in which force is exerted on the piston face (16) during the engine operating cycle (141). Operation of the exhaust valves (115) as illustratively described can allow for an engine operating cycle (141) having lesser combustion pressure with lesser scavenge air pressure.

As engine crankshaft (21) RPM increases, exhaust valve lift (142) can be increased allowing for increased flow of exhaust gases from the combustion chamber (18) and increased flow of intake air (74) into the combustion chamber (18). Additionally, the exhaust valve closed condition (140) can be adjusted to occur later in the engine operating cycle (141) to afford a greater period of time in which to scavenge the combustion chamber (18) of exhaust gases and the exhaust valve open condition (138) can be adjusted to occur earlier in the engine operating cycle to allow the greater volume of exhaust gases to egress from the combustion chamber (18). From initial engine start up, and from idle speed to maximum speed, the ability to vary exhaust valve timing of the exhaust valve open condition (138) and the exhaust valve closed condition (140) and to vary exhaust valve lift (142) can also be used to increase efficiency of a turbocharger (146). Exhaust valve timing and exhaust valve lift can be determined thorough dynamometer and emission testing in order to assure one or more of or a combination of reliability, high power output, low fuel consumption, and low exhaust emissions.

The Cooling System. Now referring primarily to FIG. 11, a cooling system (6) can include a coolant pump (147) having a coolant pump spring loaded plunger (148) which travels in a coolant pump barrel (149). The coolant pump spring loaded plunger (148) can be made responsive to a coolant pump spring (150) compressed by a coolent pump cam follower (151) which engages a coolant pump cam (152), for example, as above described for the low pressure oil pump (78). The coolant pump (147) operates to generate a flow of coolant (160A) in a coolant flow path (160B).

The Cam System. Now referring primarily to FIG. 12, a camshaft (153) having one or more cams (154) can be rotatably journaled within the engine (1). The location of camshaft (153) within the engine (1) and spacing of the one or more cams (154) along the length of the camshaft (153) allows the corresponding one or more camming surfaces (155) to engage a corresponding one or more cam followers (42)(54)(89)(104A)(151) to actuate one more of: the low pressure fuel pump (35), high pressure fuel pump (50), the low pressure oil pump (78), the high pressure oil pump (81), the second low pressure oil pump (83), and the water pump (147), or other pumps or accumulators depending upon the application.

As to particular embodiments, the one or more cams (154) can be spaced along a camshaft (153) rotationally journaled in the engine (1) discrete from the crankshaft (21); however, as to other embodiments the one or more cams (154) can be coupled and spaced apart along the length of the crankshaft (21). The cams (154) can be coupled in fixed relation on the shaft (153)(21) to radially dispose the corresponding cam noses (156) in the same or different directions about the shaft (153)(21). The shaft (153)(21) can be driven at any RPM that actuates the various pumps at the desired rate to achieve the desired amount of pressure in the corresponding system or in the high pressure accumulators (59)(105) or low pressure accumulators (92).

Figure 12:
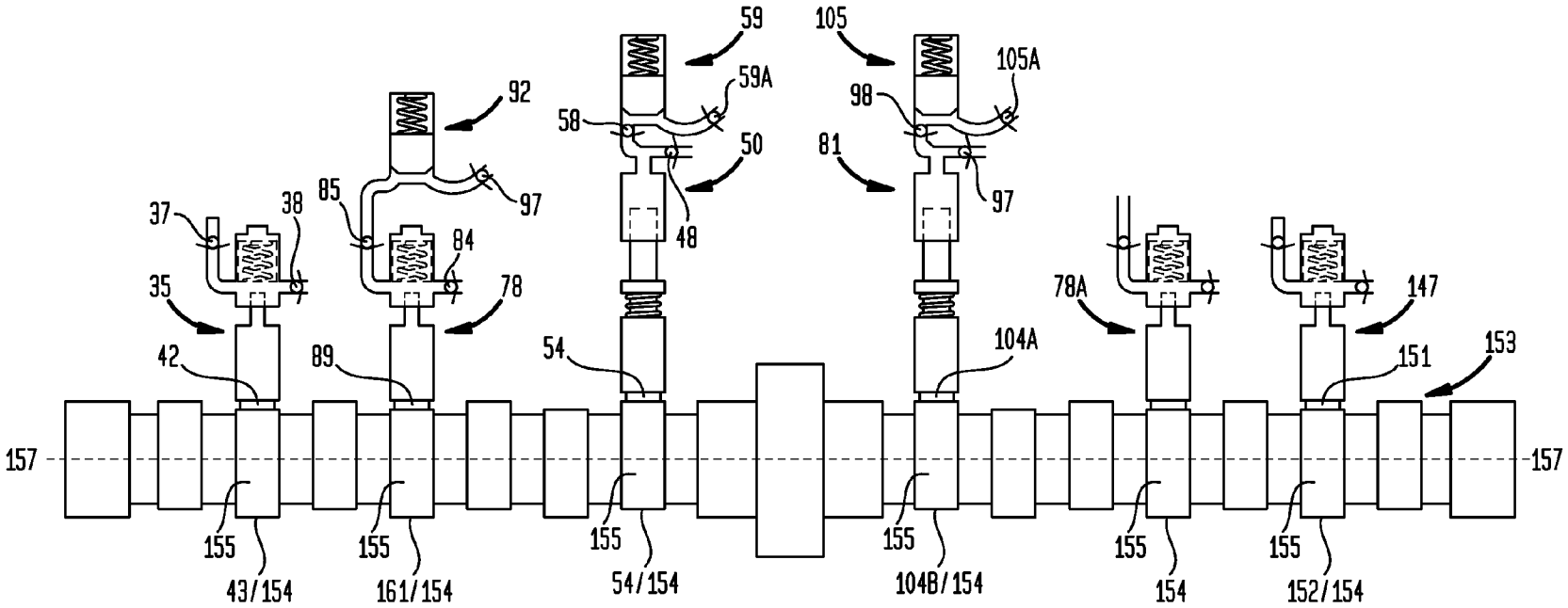
FIG. 12 is an illustrative diagram of a camshaft having a plurality of cams each having a camming surface configured to lift a corresponding cam follower to actuate a pump during the combustion period of the engine operating cycle.

As shown in the illustrative example of FIG. 12, a camshaft (153) can be journaled discrete from the crankshaft (21) and includes a plurality of cams (154) each having a camming surface (155) which rotationally engages one of a plurality of cam followers (42)(54)(89)(104A)(151). Each of the plurality of cam followers (42)(54)(89)(104A)(151) follows one of the corresponding plurality of camming surfaces (155) as the plurality of cams (154) rotate about the camshaft axis (157) to actuate each of the low pressure fuel pump (35), the high pressure fuel pump (50), the first low pressure oil pump (78), the second low pressure oil pump (78A)(to generate flow of oil to a remote oil reservoir in embodiments having a dry sump), the high pressure oil pump (81) and the water pump (147). All the cams (154) can, but need not necessarily, begin lift of the associated cam followers (42)(54)(89)(104A)(151) at about TDC and end lift at about 90° ATDC of the piston (10) (as shown in the illustrative example of FIG. 10). The camshaft (153) can be, but is not necessarily, driven in a 1:1 ratio to the crank shaft (21). As above described, the cams (154) do not directly acetate the exhaust valves (115).

The Electronic Control System. Now referring primarily to FIG. 13, embodiments of the invention can, but need not necessarily include, an electronic control system (7). Electronic control system (7) is a generic term for any system capable of controlling one or more of the electrical systems or subsystems of the engine (1) or a vehicle (30) in accordance with one or more embodiments of the invention. The electronic control system (7) in accordance with particular embodiments includes both hardware and software which at least includes an electronic control unit (158)("ECU") a ECU microcontroller (159) having an ECU processor (70) in communication with an ECU memory element (71) containing an ECU program code (72) which can be executed to control one or more of the electrical systems of the engine (1) or a vehicle (30) including an embodiment of the inventive engine (1). The ECU (158) in accordance with particular embodiments can be similar to those utilized in conventional electronically controlled diesel engines, but programmed to operate the electrical system in accordance with embodiments of the invention.

An ignition switch (162) can provide a signal to activate or deactivate the ECU (158). A crankshaft position sensor (163) ("CPS") generates a signal which allows the ECU (158) to determine the position of one or more pistons (10) in a corresponding one or more cylinders (9) in the engine (1). The ECU (158) can include an internal clock (164) which allows the ECU (158) to determine and report crankshaft (21) RPM. A throttle position sensor (165) ("TPS") generates a signal based on throttle (166) position. A coolant temperature sensor (167) ("CTS") generates a signal which allows the ECU (158) to determine coolant temperature (168) and the corresponding temperature of the engine (1). The air intake sensor (169)(or turbo boost sensor)("AIS") generates a signal which allows the ECU (158) to determine the amount of air (74) delivered to each of the one or more cylinders (9) of the engine (1).

Based on the determination of position of each piston (10), the crankshaft (21) RPM, the throttle (166) position, coolant temperature (167), and amount of air (74) delivered to each cylinders (9) of the engine (1), the ECU (158) can determine the fuel injection timing and meter the amount of fuel (31) delivered through each fuel injector (60) to each corresponding cylinder (9) of the engine (1). The ECU (158) can further determine and adjust exhaust valve timing and exhaust valve lift (142) by control of the first hydraulic actuator valve (139A) and the second hydraulic actuator valve (139B).

A lubrication pressure sensor (170) ("LPS") generates a signal which allows the ECU (158) to determine low oil pressure (90) in the low pressure side (79) of the hydraulic and lubrication system (5). A hydraulic pressure sensor (171) ("HPS") generates a signal which allows the ECU (158) to determine the high oil pressure (106) on the high pressure hydraulic side (82) of the hydraulic and lubrication system (5). A fuel pressure sensor (172) ("FPS") at the high pressure fuel accumulator (59) can generate a signal which allows the ECU (158) to determine a need for power reduction or shutdown in the case of a failure. Similarly, each of the coolant temperature sensor (167), the lubrication pressure sensor (170), the hydraulic pressure sensor (171) can generate a signal which allows the ECU (158) to determine a need for power reduction or shutdown in the case of a failure.

Figure 1E:
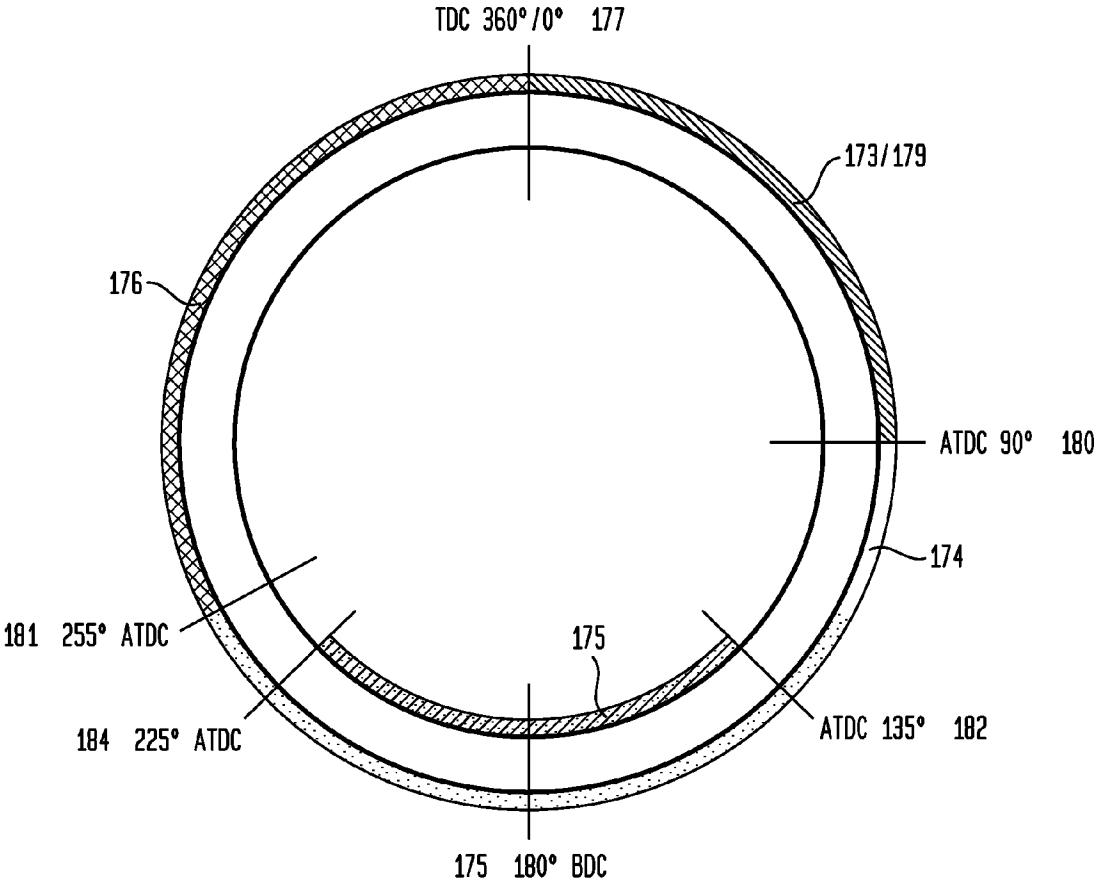
FIG. 1E is an illustrative diagram of the operating cycle of a particular embodiment of the inventive engine.
Figure 2:
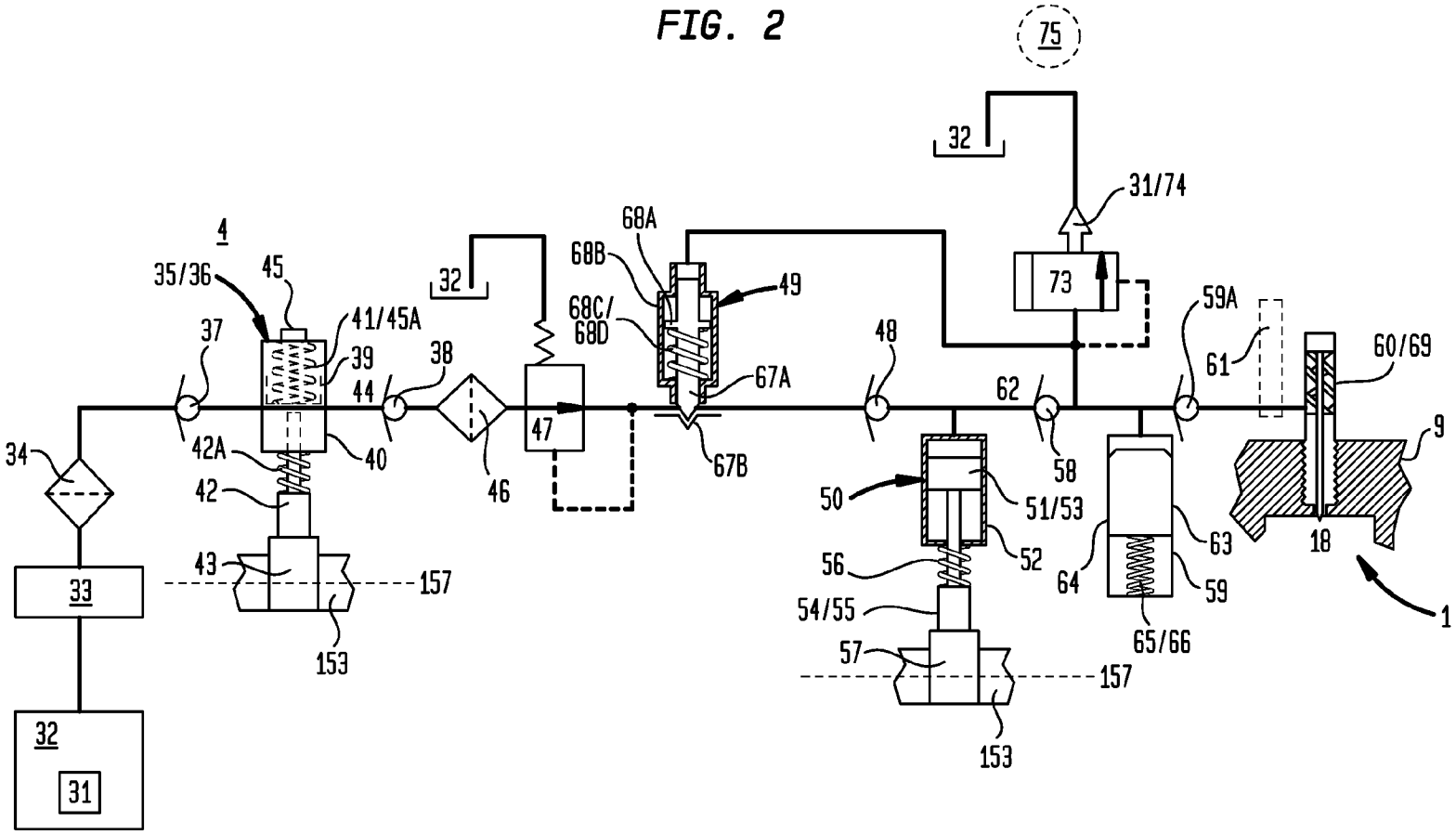
FIG. 2 is an illustrative block diagram of a fuel system of a particular embodiment of the inventive engine.

The Operation of the Engine. Now referring primarily to FIGS. 1A through 1D and FIG. 1E, the operation of a two stroke engine (1) in accordance with the invention is shown. The engine operating cycle (141) of a two-stroke engine (1) includes: a combustion period (173)(illustrative example of FIG. 1A), an exhaust period (174)(illustrative example of FIG. 1B), an scavenging period (175)(illustrative example of FIG. 1C), and a compression period (176) (illustrative example of FIG. 1D) occur in one revolution of the crankshaft (21)(from 0 through 360 mechanical degrees of rotation as shown in the illustrative example of FIG. 1E with 0 degrees and 360 degrees associated with top dead center (177) ("TDC") and 180 degrees associated with bottom dead center (178)("BDC"). As shown in the example of FIG. 1E more than one function may occur at given times during operation of a two stroke engine (1). While FIGS. 1A through 1D provide an illustrative example of a one cylinder (18) two stroke engine (1) for ease of description, the invention need not necessarily be limited to a one cylinder (18) two stroke engine (1) and the operation described can be common to two stroke engines (1) having multiple cylinders (18).

The Combustion Period. Now referring primarily to FIGS. 1A and 1E, at the beginning of the engine operating cycle (141) as the piston (10) approaches or is at TDC (0 degrees as shown in the example of FIG. 1E) an amount of fuel (31) can be injected into the combustion chamber (18) through a fuel injector (60). In compression ignition embodiments as illustrated in FIGS. 1A through 1D, the heat of compression of air (74) within the combustion chamber (18) ignites the fuel (31). In spark ignition engines, the fuel (31) is ignited by a spark from a spark plug (not shown). Combustion of the air-fuel (74)(31) mixture causes an accelerated expansion of high pressure gases, which moves the piston (10) to toward BDC (178) creating a power stroke (179). In accordance with embodiment of the invention a power stroke (179) commences upon ignition of the fuel-air (74)(31) mixture at about TDC (177) (about 0 degrees of rotation) and continues through about 90 degrees of rotation (180).

The Exhaust Period. Now referring primarily to FIGS. 1B and 1E, the exhaust period (174) in accordance with the invention commences with movement of the exhaust valves (115) toward the exhaust valve open condition (138) at about 90 degrees of rotation (180) and continues through about 255 degrees of rotation (181) terminating with the exhaust valve closed condition (140).

The Scavenging Period. Now referring primarily to FIGS. 1C and 1E, the scavenging period (175) occurs within the exhaust period (174) as the piston (10) approaches BDC (178) commencing at about 135 degrees of rotation (182) concurrent with opening of the intake ports (183) in the cylinder wall (185) and continues after BDC (178) to about 225 degrees of rotation (184) terminating with closing of the intake port (183) disposed in the cylinder wall (185). During the scavenging period (175) air (74) flows into the cylinder chamber (18) through the open intake port (183) and out from the cylinder chamber (18) through the open exhaust port (186) to replace the burnt fuel (187) in the combustion chamber (18) with fresh air (74). As to particular embodiments, artificial aspiration can be used during the scavenging period (175) to force air (74) through the open intake port (183) through the combustion chamber (18) to egress through the open exhaust port (186).

Turbocharger. Now referring primarily to FIGS. 14A and 14B, a centrifugal compressor (188) driven by an exhaust gas turbine can be fluidicly coupled to the air intake port (183) of the engine (1) to increase the air pressure entering the air intake port (183). As to particular embodiments, the centrifugal compressor (188) can take the form of a radial flow turbocharger (190) can produce sufficient air pressure to scavenge the engine at low engine speeds and turbocharge at higher engine speeds. Variable vane turbochargers, variable nozzle turbochargers, and variable geometry turbochargers can be utilized in various embodiments. All are commonly built with vanes (194) which have a vane angle (195) which variably adjusts based on engine (1) RPM and load. As to particular embodiments, the radial flow turbocharger (190) can include vanes (194) which have an adjustable vane height (195) which variably adjust based on engine (1) RPM.

The Compression Period. Now referring primarily to FIGS. 1D and 1E, the compression period (176) commences upon the exhaust valve closed condition (140) at about 255 degrees of rotation (181). As the piston (10) travels toward TDC (177), the charge of air (74) introduced into the combustion chamber (18) during the scavenging period (175) is compressed which increases the temperature the air (74) in the combustion chamber (18). Approaching or at TDC (177) the heat of compression can be sufficient to ignite the fuel (31) introduced into the combustion chamber (18) to generate the next combustion period (173) including the power stroke (179) as above described.

Advantages of the Invention. In conventional engines, in addition to the power needed to compress the air (74) during the compression period (176) of the engine operating cycle (141), conventional engines also use power to inject fuel, open valves, pump water, pump oil, transfer fuel, and turn an alternator. All of these are drawing power when the cylinder (18) is not producing power, typically between about ninety degrees (90°) after top dead center (180) to about TDC (177) (about 270° of rotation), or until the next power stroke (179). All of the power used during the period in which the cylinder is not producing must be made up by an increase in the amount of rotating mass (192) coupled to the crankshaft (21) to rotate the crankshaft (21) and position the piston (10) in the combustion chamber (18) for the next power stroke (179). In conventional engines, the rotating mass (192) can take the form of a fly wheel (not shown) connected to one end of the crankshaft (21). However, the larger the additional rotating mass (192), the greater the amount of power that must be produced in the combustion period (173) needed to rotate it, thereby increasing fuel consumption, slowing acceleration, and requiring more power at initial start-up of the engine (1).

In comparison, all or a greater portion of, the power requirements of the inventive engine, with the exception of compression and operation of an alternator, can be met during the combustion period (173) or during the power stroke (179), and without reducing the breadth of the forgoing, can occur in the engine operating cycle (141) between about TDC (177) and about 90° ATDC (180).

In this regard, the inventive cam system (3) above described can be configured to actuate the low pressure fuel pump (35), the high pressure fuel pump (50), the first low pressure oil pump (78), the second low pressure oil pump (78A)(to generate flow of oil to a remote oil reservoir in embodiments having a dry sump), the high pressure oil pump (81), the water pump (147), or any other pumps or devices, by beginning lift of the associated cam followers (42)(54)(89)(151) at about TDC (177) and end lift at about 90° ATDC (180) of the piston (10).

Additionally, excess power produced during the combustion period (173) can be stored in the above described inventive high pressure fuel accumulator (59), low pressure lubrication accumulator (92), high pressure hydraulic accumulator (105), or other pressure accumulators, which can be delivered without additional power output by a cylinder (18) to meet the power demands to actuate the exhaust valves (115), the low and high pressure fuel pumps (35) (50), the low and high pressure oil pumps (78)(83)(81), the water pump (147), or actuate other hydraulic components associated with the engine (1) or a vehicle (30).

Moreover, embodiments of the high pressure fuel pump (50), the high pressure oil pump (81), the low pressure fuel pump (35), the first low pressure oil pump (78), the second low pressure oil pump (78A)(to generate flow of oil to a remote oil reservoir in embodiments having a dry sump), and the water pump (147) can be configured as above described to reduce the operational power requirements when the corresponding high and low pressure accumulators (59)(92)(105) are within the delimited pressure ranges.

Also in comparison to conventional engines, because all or a greater portion of the power requirements are met during the combustion period and not during the period in which the engine is not producing power the amount of rotating mass (192) coupled to the crankshaft (21) to return the piston (10) to the position of the next combustion period (173) can be substantially less overall, thereby increasing reducing fuel consumption, increasing acceleration, and reducing power requirements at initial start-up of the engine (1).

Additionally, because the amount of additional mass (192) can be substantially reduced, the conventional fly wheel can be eliminated and the amount of additional mass (192) can be made integral to the medial portion (193) of the crankshaft (21). Moreover, because all or a greater portion of the operational power of the exhaust valves (115), low and high fuel and oil pumps (78)(83)(81) and the water pump (147) can be delivered during the combustion period (173) with the power pulse absorbed by the one or more cams (154) actuating the corresponding pumps (35)(50)(78)(78A)(83)(147) a substantial reduction in the operating vibration of the engine (1) can be achieved without use of a conventional flywheel.

Also, by comparison to conventional engines which do not include the inventive exhaust valve actuation system (2), the inventive exhaust valve actuation system (2) allows for a wider operational performance range of the exhaust valves (115) with respect to timing of the exhaust valve open condition (138) and the exhaust valve closed condition (140) separately with concurrent adjustment of the exhaust valve lift (142) and without limitation to the breadth of the forgoing the inventive bridge acutation assembly (114) reduces clearance and affords greater precision to the concurrent operation of multiple valves (115) per cylinder (18).

As can be easily understood from the foregoing, the basic concepts of the present invention may be embodied in a variety of ways. The invention involves numerous and varied embodiments of a compression ignition engine and methods for making and using such compression ignition engine including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "turbocharger" should be understood to encompass disclosure of the act of "turbocharging"—whether explicitly discussed or not—and, conversely, were there effectively disclosure of the act of "turbocharging", such a disclosure should be understood to encompass disclosure of a "turbocharger" and even a "means for turbocharging." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the compression ignition engines herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claimed:

1. A method of improving operational efficiency of an engine comprising the steps of:

a. delivering an amount of input power to a shaft rotationally journaled in the engine;

b. generating three hundred and sixty degrees of rotation of the shaft during the engine's operating cycle, the operating cycle comprising:

i. a combustion period commencing at or about zero degrees of rotation of the shaft and terminating at or about 90 degrees of rotation of the shaft, wherein fuel is injected into a combustion chamber at or about zero degrees of rotation of the shaft, and wherein the fuel mixes with air within the combustion chamber, wherein combustion of the air-fuel mixture within the combustion chamber causes an accelerated expansion of high pressure gases, moving one or more pistons connected to the shaft from top dead center of one or more corresponding cylinder chambers toward bottom dead center of the one or more cylinder chambers, wherein a power stroke commences upon ignition of the air-fuel mixture at the commencement of the combustion period and continues through the termination of the combustion period, wherein a rate of the rotation of the shaft coincides with the amount of input power, wherein the input power is generated during the combustion period;

ii. an exhaust period commencing at or about 90 degrees of rotation of the shaft with an opening of one or more exhaust valves, and terminating at or about 255 degrees of rotation of the shaft with a closing of the one or more exhaust valves;

iii. a scavenging period commencing at or about 135 degrees of rotation of the shaft, concurrent with opening of one or more intake ports in a cylinder wall, and terminating with a closing of the one or more intake ports at or about 225 degrees of rotation of the shaft, wherein during the scavenging period air flows into the cylinder chamber through the intake port and out of the cylinder chamber through the exhaust port, wherein the airflow displaces burnt fuel from the combustion chamber; and iv. a compression period commencing at or about 255 degrees of rotation of the shaft, concurrent with the closing of the exhaust valve, wherein as the one or more pistons travel upward toward top dead center of one or more corresponding cylinder chambers, the air introduced into the combustion chamber during the scavenging period is compressed, increasing the temperature of the air, wherein the heat of compression is sufficient to ignite fuel introduced into the combustion chamber to initiate a successive combustion period, wherein the engine is a twostroke engine delivering power on every downward movement of the piston;

c. rotating one or more cams, each having a camming surface having a fixed orientation which begins lift and ends lift within the combustion period;

d. engaging one or more cam followers to the camming surface, wherein the one or more cam followers drive one or more pumps during the combustion period, wherein the one or more pumps generate a flow of one or more fluids;

e. accumulating the one or more fluids in one more fluid accumulators during the combustion period, wherein the one or more fluids are accumulated based on power generated during the combustion period, wherein the one or more fluids are stored under pressure within the one or more fluid accumulators;

f. releasing the one or more fluids from the one or more fluid accumulators, wherein the one or more fluids are released outside of the combustion period;

g. the one or more fluids transferring stored pressure as energy, wherein the release of the one or more fluids provides power outside of the combustion period, wherein the power from the released one or more fluids provides all power to operate a lubrication system, a fuel injection system, and for engine valve actuation, wherein springs that are compressed during the combustion period provide power to transfer fuel and circulate coolant outside of the combustion period.

2. The method of claim 1, wherein the shaft comprises a crankshaft having a crank throw, and wherein the method further comprises the steps of:

a. generating reciprocal travel of the one or more pistons within the one or more cylinder chambers, each piston coupled by a connecting rod to the crank throw, wherein the reciprocal travel delivers the amount of input power to the crankshaft.

3. The method of claim 2, further comprising the step of:

a. the one or more cam followers beginning lift at about zero degrees of rotation; and b. ending lift of the one or more cam followers at about ninety degrees of rotation.

4. The method of claim 3, further comprising the step of spacing the one or more cams along the length of the crankshaft.

5. The method of claim 3, further comprising the step of spacing the one or more cams along the length of a camshaft rotationally journaled in the engine.

6. The method of claim 5, wherein the one or more pumps comprise a pump selected from the group consisting of a low-pressure fuel pump, a high-pressure fuel pump, a low-pressure oil pump, a high-pressure oil pump, and a coolant pump.

7. The method of claim 6, further comprising the step of:

a. generating travel of an accumulator piston in an accumulator cylinder of the one or more fluid accumulators, wherein the travel of the accumulator piston is opposed by compression of one or more springing elements engaged to the accumulator piston.

8. The method of claim 7, wherein each of the one or more springing elements has a corresponding compression load, wherein the one or more springing elements are received in the accumulator cylinder, wherein the method further comprises the step of the one or more springing elements regulating an amount of fluid pressure within the one or more fluid accumulators.

9. The method of claim 8, wherein the amount of fluid pressure is between 50 psi and 50,000psi.

10. The method of claim 8, wherein at least one of the one or more fluid accumulators is a highpressure fuel accumulator, wherein an amount of fuel exerts fluid pressure of between 10,000 psi to 50,000psi.

11. The method of claim 1, further comprising:

a. a first pair of valves regulating a flow of gases within the one or more cylinder chambers with a first valve bridge, the first valve bridge comprising:
   i. a first bridge element;
   ii. a first pair of bridge flanges extending in opposed facing relation from the first bridge element; and
   iii. a first pair of aperture elements coaxially disposed through the first pair of bridge flanges to define a pivot axis;

b. disposing a pivot element having a length disposed between a pair of pivot ends in the first pair of aperture elements allowing the first valve bridge to pivot about the pivot axis;

c. pivotably coupling a pair of hydraulic actuators one each to the pair of pivot ends of the pivot element; and d. operating the pair of hydraulic actuators to move the first bridge element to generate travel in the first pair of valves.

12. The method of claim 11, further comprising the steps of:

a. concurrently engaging a second pair of valve stems of a second pair of valves operable to regulate a flow of gases within the cylinder with a second valve bridge, the second valve bridge comprising:
   i. a second bridge element;
   ii. a second pair of bridge flanges extending in opposed facing relation from the second bridge element; and
   iii. a second pair of aperture elements coaxially disposed through the second pair of bridge flanges;

b. disposing the pivot element in the second pair of aperture elements allowing the second valve bridge to pivot about the pivot axis; and c. operating the pair of hydraulic actuators to move the second bridge element to generate travel in the second pair of valves.

13. The method of claim 12, further comprising the steps of:

a. fluidly coupling the pair of hydraulic actuators to the high-pressure oil pump and a high-pressure oil accumulator; and b. a pair of computer-controlled solenoid valves allowing ingress and egress of oil from the pair of hydraulic actuators, wherein the pair of hydraulic actuators generate travel in the first or the second pair of valves.

14. The method of claim 8, wherein at least one of the one or more fluid accumulators is a low-pressure oil accumulator, wherein an amount of oil exerts an amount of fluid pressure of between 50 psi and 100 psi.

15. The method of claim 14, wherein if there is more than one fluid accumulator, another of the one or more fluid accumulators is a high-pressure oil accumulator, wherein the amount of oil exerts the amount of fluid pressure of between 2,500 psi and 5,000psi.

16. The method of claim 13, wherein the engine operates on a two-stroke cycle, the flow of intake air is controlled by piston movement opening and closing ports in the cylinder, wherein regulation of exhaust gas flow is accomplished by opening or closing valves in a cylinder head.

17. The method of claim 1, wherein valves in the cylinder head are controlled by a valve bridge assembly comprising:

a. a pair of valve bridge elements;

b. a pair of valve bridge flanges on each valve bridge element;

c. a pair of aperture elements coaxially disposed through both pair of the valve bridge flanges to define a pivot axis;

d. a pivot element having a length disposed between a pair of pivot ends across both pair of aperture elements allowing both valve bridges to pivot about the pivot axis; and e. a pair of hydraulic actuators, wherein one each of the pair of hydraulic actuators are in communication with the pair of pivot ends of the pivot element, wherein the pair of hydraulic actuators are moved by hydraulic oil pressure generating travel in all valves simultaneously.

18. An engine operating cycle defined by three hundred and sixty degrees of rotation of a crankshaft, the operating cycle comprising:

a. a combustion period commencing at or about zero degrees of rotation of the crankshaft and terminating at or about 90 degrees of rotation of the crankshaft, wherein fuel is injected into a combustion chamber at or about zero degrees of rotation of the crankshaft, and wherein the fuel mixes with air within the combustion chamber, wherein combustion of the air-fuel mixture within the combustion chamber causes an accelerated expansion of high pressure gases, moving one or more pistons connected to the crankshaft from top dead center of one or more corresponding cylinder chambers toward bottom dead center of the one or more corresponding cylinder chambers, wherein a power stroke commences upon ignition of the air-fuel mixture at the commencement of the combustion period and continues through termination of the combustion period;

b. an exhaust period commencing at or about 90 degrees of rotation of the crankshaft with an opening of one or more exhaust valves, and terminating at or about 255 degrees of rotation of the crankshaft with a closing of the one or more exhaust valves;

c. a scavenging period commencing at or about 135 degrees of rotation of the crankshaft, concurrent with opening of one or more intake ports in a cylinder wall, and terminating with a closing of the one or more intake ports at or about 225 degrees of rotation of the crankshaft, wherein during the scavenging period air flows into the cylinder chamber through the intake port and out of the cylinder chamber through the exhaust port, wherein the airflow displaces burnt fuel from the combustion chamber; and d. a compression period commencing at or about 255 degrees of rotation of the crankshaft, concurrent with the closing of the exhaust valve, wherein as the one or more pistons travel upward toward top dead center of one or more corresponding cylinder chambers, the air introduced into the combustion chamber during the scavenging period is compressed, increasing the temperature of the air, wherein the heat of compression is sufficient to ignite fuel introduced into the combustion chamber to initiate a successive combustion period.

* * * * *